US011031692B1

(12) United States Patent
Hu

(10) Patent No.: US 11,031,692 B1
(45) Date of Patent: Jun. 8, 2021

(54) SYSTEM INCLUDING ANTENNA AND ULTRA-WIDEBAND ORTHO-MODE TRANSDUCER WITH RIDGE

(71) Applicant: Nan Hu, Irvine, CA (US)

(72) Inventor: Nan Hu, Irvine, CA (US)

(73) Assignee: Nan Hu, Irvine, CA (US)

( * ) Notice: Subject to any disclaimer, the term of this patent is extended or adjusted under 35 U.S.C. 154(b) by 0 days.

(21) Appl. No.: 16/852,585

(22) Filed: Apr. 20, 2020

(51) Int. Cl.

| | |
|---|---|
| ***H01Q 13/10*** | (2006.01) |
| ***H01Q 5/25*** | (2015.01) |
| ***H01Q 13/02*** | (2006.01) |
| ***H01Q 13/06*** | (2006.01) |

(52) U.S. Cl.
CPC ..... *H01Q 5/25* (2015.01); *H01Q 13/0208* (2013.01); *H01Q 13/0275* (2013.01); *H01Q 13/06* (2013.01)

(58) Field of Classification Search
None
See application file for complete search history.

(56) References Cited

U.S. PATENT DOCUMENTS 3,569,870 A * 3/1971 Foldes ..... G01S 13/4409 333/21 R
6,087,908 A * 7/2000 Haller ..... H01P 1/161 333/122
2002/0175875 A1* 11/2002 Verstraeten ..... H01Q 5/47 343/786
2003/0142027 A1* 7/2003 Moheb ..... H01Q 1/247 343/772
2010/0141543 A1* 6/2010 Parekh ..... H01Q 19/19 343/786
2010/0194655 A1* 8/2010 Cook ..... H01Q 13/02 343/756
2013/0342282 A1* 12/2013 Uher ..... H01P 1/2131 333/135
2017/0141478 A1* 5/2017 Jensen ..... H01P 3/123
2020/0176841 A1* 6/2020 Ayoub ..... H01P 1/171
2020/0313296 A1* 10/2020 Mitchelson ..... H01Q 19/193
2020/0343647 A1* 10/2020 Runyon ..... H01Q 13/02

* cited by examiner

*Primary Examiner* — Trinh V Dinh
(74) *Attorney, Agent, or Firm* — Gang Yu

(57) ABSTRACT

A system including an antenna and an ultra-wideband Ortho-Mode Transducer with ridges is provided. The ultra-wide-band Ortho-Mode Transducer includes at least at least an ultra-wideband Ortho-Mode Transducer and a radiation antenna, wherein the ultra-wideband Ortho-Mode Transducer comprises a first channel inside, the radiation antenna comprises a second channel inside, a common port of the first channel is connected to a first antenna port of the second channel, a plurality of ridges with a square cross section are arranged in the first channel, and the plurality of ridges arranged in the first channel bulge into the first channel.

20 Claims, 18 Drawing Sheets

SYSTEM INCLUDING ANTENNA AND ULTRA-WIDEBAND ORTHO-MODE TRANSDUCER WITH RIDGE

TECHNICAL FIELD

The present disclosure relates to the technical field of ultra-wideband, and more particularly, to a system including an antenna and an ultra-wideband Ortho-Mode Transducer (OMT) with ridges.

BACKGROUND

As a fifth generation cell mobile communication system, it is characterized by high speed, low latency and dense connection. Compared with the previous generations communication systems, the frequency range used by the fifth generation communication system has significantly improved. During the research cycle of the 2019 World Infinite Telecommunication Conference, a new issue 1.13 was set up to look for available frequency bands above 6 GHz, and the research frequency range was 24.25-86 GHz.

That is, new requirements of 5G testing system are as follows: 1, a series of antennas suitable for various test methods are needed; 2, 5G millimeter wave frequency bands 24-50 GHz, 22.5-45 GHz need to be covered; 3, dual polarization, high cross-polarization (45 dB) and high port isolation (40 dB) are needed.

Similarly, for the new requirements of 5G testing system, the existing products have the following bottlenecks: 1, there is no 5G millimeter wave testing frequency band; 2, there is no standard waveguide to cover the 5G millimeter wave frequency band; 3, the cross-polarization of existing dual polarization antennas are specifically 30 dB and the port isolation is 20 dB.

For the above technical problems, no solution has been obtained at present.

SUMMARY

The present disclosure provides a system including an antenna and an ultra-wideband Ortho-Mode Transducer with ridges, intended to solve the problem that new requirements of 5G testing cannot be met by existing system.

In order to solve the above problem, according to an aspect of the present disclosure, the present disclosure provides a system including an antenna and an ultra-wideband Ortho-Mode Transducer with ridges. The system including an antenna and an ultra-wideband Ortho-Mode Transducer with ridges includes at least an ultra-wideband Ortho-Mode Transducer and a radiation antenna. The ultra-wideband Ortho-Mode Transducer comprises a first channel. The radiation antenna comprises a second channel. A common port of the first channel is connected to a first antenna port of the second channel. A plurality of ridges with a square cross section are arranged in the first channel. The plurality of ridges arranged in the first channel bulge into the first channel.

Optionally, the common port of the first channel is a square port, the number of the ridge is four, and one end of each ridge is arranged on a side wall of the square port.

Optionally, the first channel is divided into a separation channel, a combining channel and a matching channel. One end of the separation channel is provided with the common port, and the other end is provided with two side ports and a through port. One end of the combining channel is connected to the two side ports of the separation channel, and the other end is a first rectangular port. One end of the matching channel is connected to the through port of the separation channel, and the other end is a second rectangular port. The four ridges are divided into a first group of ridges and a second group of ridges; two ridges of the first group of ridges are located on a first side wall and a second side wall and extends to the combining channel, the first side wall and the second side wall are opposite walls of the separation channel respectively; two ridges of the second group of ridges are located on a third side wall and a fourth side wall respectively, the third side wall and the fourth side wall are opposite walls of the separation channel Optionally, the combining channel includes a combining sub-channel, a first conversion sub-channel and a second conversion sub-channel. A first end of the first conversion sub-channel and a first end of the second conversion sub-channel are connected to the two side ports of the separation channel respectively, and a second end of the first conversion sub-channel and a second end of the second conversion sub-channel are both connected to the combining sub-channel. In a direction of close to the combining sub-channel, a height of each ridge of the first group of ridges gradually decreases in the first conversion channel and the second conversion channel, and is smoothly transited from a single-ridge waveguide to a rectangular waveguide, and the combining sub-channel is configured to combine two rectangular waveguides into one rectangular waveguide.

Optionally, in a direction from the first end to the second end of the first conversion channel, a ridged surface of the first conversion channel is widened from a first preset position; and in a direction from the first end to the second end of the second conversion channel, a ridged surface of the second conversion channel is widened from a second preset position.

Optionally, the second group of ridges satisfies at least one of following:

in a direction extending from the common port to the inside of the first channel, a height of each ridge of the second group of ridges gradually increases from a third preset position until a ridge pitch between the two ridges of the second group of ridges becomes a first threshold, the first threshold is a cross-sectional width of the through port of the separation channel;

in a direction extending from the common port to the inside of the first channel, a width of each ridge of the second group of ridges gradually decreases from a fourth preset position until the width of each ridge of the second group of ridges becomes a second threshold.

Optionally, the two side ports are in an area of the separation channel, and the ridge pitch of the two ridges of the second group of ridges is the first threshold in the area of the separation channel.

Optionally, after the ridge pitch of the two ridges of the second group of ridges becomes the first threshold, ridge side walls of each ridge of the second group of ridges are gradually separated at a preset angle until the distance between the ridge side walls of each ridge becomes a third threshold. After the distance between the ridge side walls of each ridge becomes the third threshold, the ridge side walls are combined in pairs and transformed into side walls of the two side ports of the separation channel.

Optionally, after the ridge pitch of the two ridges of the second group of ridges becomes the first threshold, a first side surface and a second side surface of the separation channel are turned at right angles to transform into the side walls of the two side ports of the separation channel, a longitudinal section of the first side surface and a longitudinal section the second side surface are L-shaped.

Optionally, the matching channel smoothly transits the through port of the separation channel to a standard rectangular port based on a staircase structure, and a broadside size of each step in the staircase structure meets the Chebyshev impedance transformation.

Optionally, the matching channel is turned at a right angle at a first position, and a stepped structure is arranged on the outside of the first position.

Optionally, the ultra-wideband Ortho-Mode Transducer is composed of a plurality of components, the plurality of components are connected to form the first channel, each ridge is arranged on any one of the components.

Optionally, in a case that a port shape of the common port does not match a port shape of the first antenna port, the ultra-wideband Ortho-Mode Transducer further comprises a port transition device, the port transition device comprises a third channel inside, a first transition port of the third channel is connected to the common port and a port shape of the first transition port matches the port shape of the common port, a second transition port of the third channel is connected to the first antenna port and a port shape of the second transition port matches the port shape of the first antenna port, and the third channel is configured to smoothly transit the first transition port into the second transition port.

Optionally, in a case that a port shape of the common port does not match a port shape of the first antenna port, the radiation antenna further includes a port transition device. The port transition device comprises a third channel inside. A first transition port of the third channel is connected to the common port, and a port shape of the first transition port matches the port shape of the common port. A second transition port of the third channel is connected to the first antenna port, and a port shape of the second transition port matches the port shape of the first antenna port. The third channel is configured to smoothly transit the first transition port into the second transition port.

Optionally, the first transition port is a quad-ridge square port, a port shape of the quad-ridge square port matches the port shape of the common port, the second transition port is a quad-ridge circular port, and a port shape of the quad-ridge circular port matches the port shape of the first antenna port, the quad-ridge circular port is formed by uniformly arranging four ridges with a square cross-section on an inner wall of the circular port.

Optionally, the first transition port is a quad-ridge square port, a port shape of the quad-ridge square port matches the port shape of the common port, the second transition port is a first circular port, and a port shape of the first circular port matches the port shape of the first antenna port, the first circular port is a circular port without the ridge on an inner wall.

Optionally, the first transition port is a quad-ridge square port, a port shape of the quad-ridge square port matches the port shape of the common port, the second transition port is a first square port, and a port shape of the first square port matches the port shape of the first antenna port, the first square port is a square port without the ridge on an inner wall.

Optionally, the ultra-wideband. Ortho-Mode Transducer satisfies at least one of following:

a first fixed portion is arranged on an outer periphery of the first transition port, the first fixed portion is configured to connect the port transition device and the ultra-wideband Ortho-Mode Transducer;

a second fixed portion is arranged on an outer periphery of the second transition port, the second fixed portion is configured to connect the port transition device and the radiation antenna.

Optionally, the radiation antenna is divided into a transition portion and a horn caliber surface portion along an electromagnetic wave transmission direction, and the horn caliber surface portion is provided with a plurality of grooves, the plurality of grooves is a plurality of concentric circular grooves or a plurality of annular grooves, the plurality of concentric circular grooves are provided on a top surface of the horn caliber surface portion, and the plurality of annular grooves are provided along an inner wall of the second channel of the horn caliber surface portion.

Optionally, in a case that the plurality of grooves are the plurality of concentric circular grooves, the plurality of concentric circular grooves are arranged at equal intervals on the outer periphery of the second antenna port; and in a case that the plurality of grooves are the plurality of annular grooves, the plurality of annular grooves are arranged side by side on the inner wall of the second channel along the electromagnetic wave transmission direction, the first antenna port is a port, away from the horn caliber surface portion, of the second channel, and the second antenna port is a port, near the horn caliber surface portion, of the second channel.

Optionally, the second channel located in the transition portion is a first antenna channel and the second channel located in the horn caliber surface portion is a second antenna channel, in a direction from the first antenna port to the second antenna port, the radiation antenna satisfies at least one of following:

a channel diameter of the first antenna channel remains unchanged or increases gradually;

a channel diameter of the second antenna channel remains unchanged or increases gradually.

Optionally, the second channel located in the transition portion is a first antenna channel and the second channel located in the horn caliber surface portion is a second antenna channel, wherein the first antenna channel is provided with a plurality of ridges of antenna with a square cross-section side by side at equal intervals, and the ridges of antenna on an inner wall of the first antenna channel bulge into the first antenna channel.

Optionally, in a direction from the first antenna port to the second antenna port, a height of the antenna ridge arranged on the inner wall of the first antenna channel gradually decreases.

Optionally, the antenna ridge arranged on the inner wall of the first antenna channel is divided into a first part, a second part and a third part, a height of the first part is constant, a height of the second part decreases linearly, and a height of the third part decreases curvedly.

Optionally, in a case that N ridges of antenna are arranged on the inner wall of the first antenna channel, the transition portion of the radiation antenna is provided with N groups of first connecting members, and second connecting members are arranged on bottom surfaces of the N ridges of antenna, the first connecting members and the second connecting members are cooperatively configured to fix the ridges of antenna on the inner wall of the first antenna channel.

Optionally, in a case that N ridges of antenna are arranged on the inner wall of the first antenna channel, N positioning grooves are provided on the inner wall of the first antenna channel of the radiation antenna, the positioning grooves and the ridges of antenna are arranged in a one-to-one correspondence to fix the ridges of antenna into the positioning grooves.

Optionally, the radiation antenna further includes a third fixed portion, the third fixed portion is arranged on an outer periphery of the first antenna port, and the third fixed portion is provided with at least one third connecting member for fixed the radiation antenna.

According to the technical solution of the present disclosure, the ultra-wideband Ortho-Mode Transducer has a ridge structure at a common port, so that the ultra-wideband Ortho-Mode Transducer has a wider operating bandwidth, a higher port isolation and a higher cross polarization isolation. Meanwhile, multiple octave (at least 2 octave) is achieved with good impedance matching.

BRIEF DESCRIPTION OF THE DRAWINGS

The accompanying drawings, which constitute a part of this disclosure, are used to provide a further understanding of the present disclosure, and the exemplary embodiments of the present disclosure and the description thereof are used to explain the present disclosure, but do not constitute improper limitations to the present disclosure. In the drawings.

The drawings include the following reference signs:

10, ultra-wideband Ortho-Mode Transducer; 111, common port; 112, side port; 113, through port; 121, combining sub-channel; 122, first conversion channel; 123, second conversion channel; 140, staircase structure; 141, first preset position; 142, second preset position; 143, third preset position; 144, fourth preset position; 10*a*, first group of ridges; 10*b*, second group of ridges;

20, radiation antenna; 211, transition portion; 212, horn caliber surface portion; 221, concentric circular groove; 222, annular groove; 231, first antenna port; 232, second antenna port; 241, first antenna channel; 242, second antenna channel; 250, antenna ridge; 250*a*, first part; 250*b*, second part; 250*c*, third part, 251, first connecting member; 252, second connecting member; 253, positioning groove; 260, third fixed portion;

30, port transition device; 31, first transition port; 311, quad-ridge square port; 32, second transition port; 321, quad-ridge circular port; 322, first circular port; 323, first square port; 33, first fixed portion; 34, second fixed portion, 40, single-ridge waveguide; 50, rectangular waveguide.

DETAILED DESCRIPTION OF THE EMBODIMENTS

The technical solutions in the embodiments of the present disclosure will be clearly and completely described hereinbelow with the drawings in the embodiments of the present disclosure. It is apparent that the described embodiments are only part of the embodiments of the present disclosure, not all of the embodiments. The following description of at least one exemplary embodiment is only illustrative actually, and is not used as any limitation for the present disclosure. On the basis of the embodiments of the present disclosure, all other embodiments obtained on the premise of no creative work of those of ordinary skill in the art should fall within the scope of protection of the present disclosure.

Figure 1:
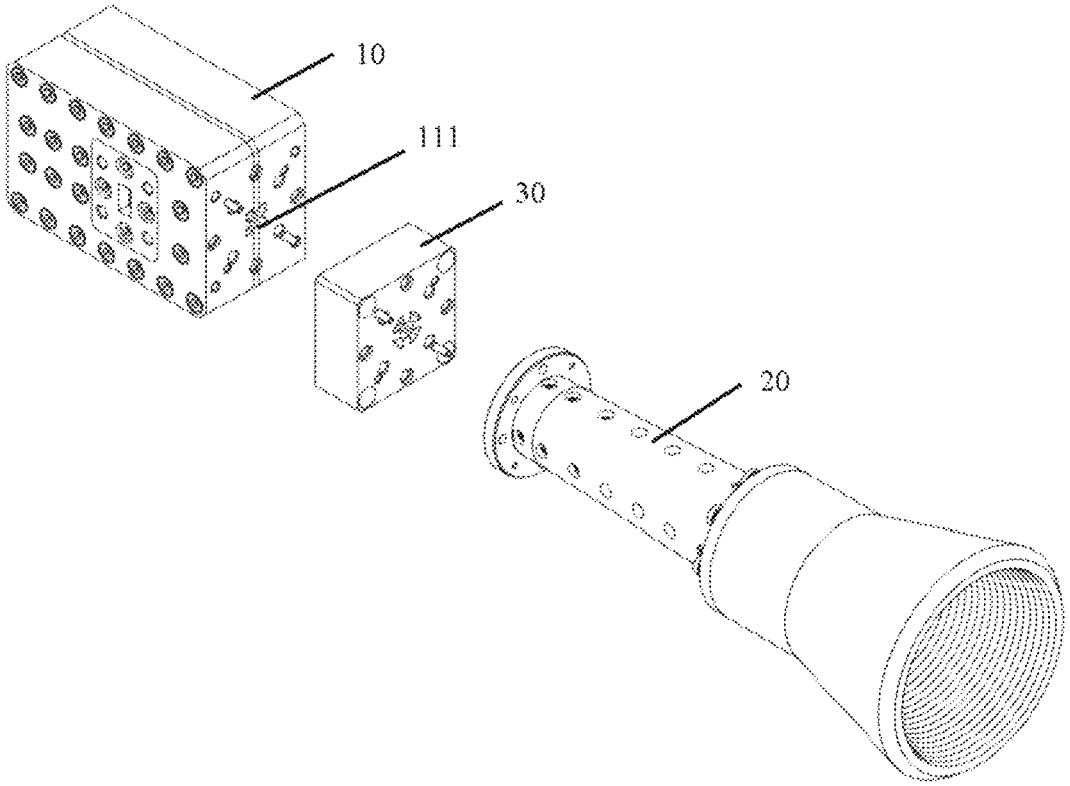
FIG. 1 is a schematic diagram 1 of an ultra-wideband Ortho-Mode Transducer according to this disclosure.

As shown in FIG. 1, some embodiments of this disclosure provides a system including an antenna and an ultra-wideband Ortho-Mode Transducer with ridges. The system including an antenna and an ultra-wideband Ortho-Mode Transducer (OMT) with ridges includes at least an ultra-wideband Ortho-Mode Transducer and a radiation antenna. The ultra-wideband Ortho-Mode Transducer comprises with a first channel. The radiation antenna comprises a second channel. A common port of the first channel is connected to a first antenna port of the second channel. A plurality of ridges with a square cross section are arranged in the first channel. The plurality of ridges arranged in the first channel bulge into the first channel.

For the ultra-wideband Ortho-Mode Transducer (OMT), it is to be noted that:

The common port in the existing OMT structures is mostly square waveguide port or circular waveguide port, the operating frequency range is widened by only 1-2 octave, and the processing difficulty is large. However, the ultra-wideband Ortho-Mode Transducer adopted in this disclosure has a ridge structure at the common port. The ridge structure enables the ultra-wideband Ortho-Mode Transducer to achieve a wider operating bandwidth, a higher port isolation and a higher cross polarization isolation. Meanwhile, multiple octave (at least 2 octave) is achieved with good impedance matching.

Figure 2:
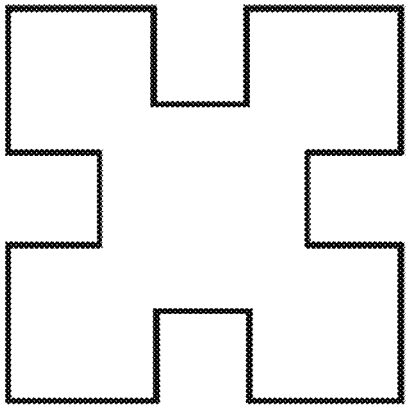
FIG. 2 is a schematic diagram of a common port of an ultra-wideband Ortho-Mode Transducer in FIG. 1.

In an optional embodiment, the common port of the first channel is a square port, and the number of the ridge is four, and one end of each ridge is arranged on a side wall of the square port and located in the middle of the side wall to form a quad-ridge square port as shown in FIG. 2.

Figure 8:
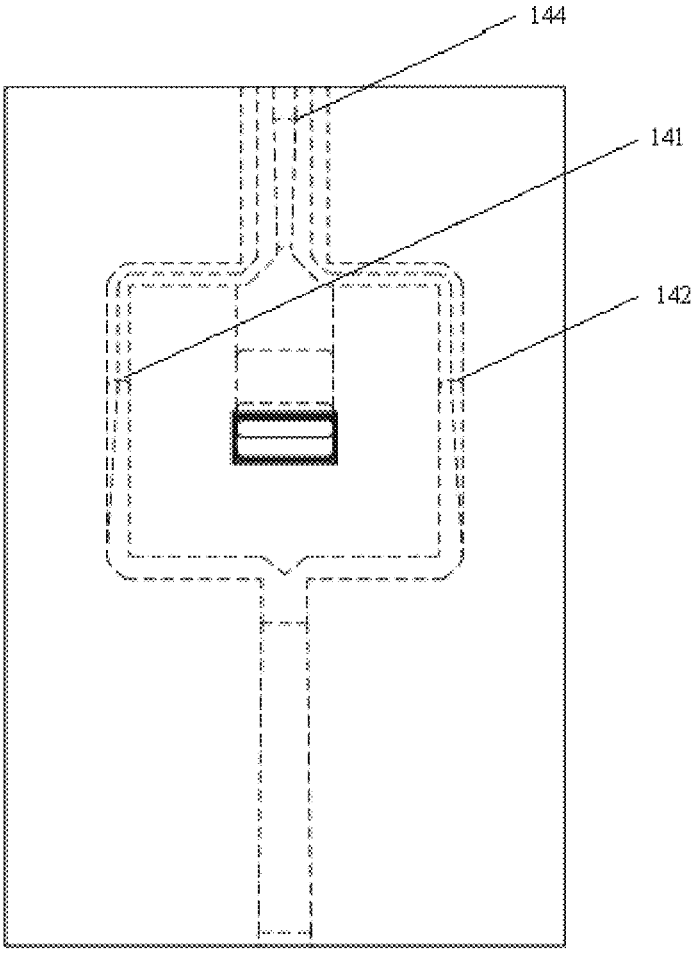
FIG. 8 is a front perspective view of an ultra-wideband Ortho-Mode Transducer in FIG. 1.

The cross-sectional sizes of the quad-ridge square port satisfy the following formula:

$$f_c = \frac{1}{\pi\sqrt{\mu\varepsilon}\sqrt{\left(\frac{a_2}{b_2} + \frac{2C_f}{\varepsilon}\right)(a_1 - a_2)b_1}},$$

$$c_f = \frac{\varepsilon}{\pi}\left|\frac{T^2+1}{T} ln\frac{1+T}{1-T} - 2ln\frac{4T}{1-T^2}\right|, T = \frac{b_2}{b_1},$$

where a1 is a long side length of the common port, a2 is a ridge width, b1 is a broadside length of the common port, b2 is a ridge pitch, u is a relative permeability, ε is a relative dielectric constant, fc is a cutoff frequency, and Cf is an edge capacitance, as shown in FIG. 8.

That is, the ultra-wideband Ortho-Mode Transducer provided by this disclosure can calculate the cut-off frequencies of quad-ridge square ports of different sizes by the above formula.

In an optional embodiment, the first channel of the ultra-wideband Ortho-Mode Transducer is divided into a separation channel, a combining channel and a matching channel. One end of the separation channel is provided with the common port, and the other end is provided with two side ports and a through port. One end of the combining channel is connected to the two side ports of the separation channel, and the other end is a first standard rectangular port. One end of the matching channel is connected to the through port of the separation channel, and the other end is a second standard rectangular port.

That is, the ultra-wideband Ortho-Mode Transducer is provided with a separation channel, a combining channel and a matching channel. The separation channel is configured to separate waves transmitted by the common port into a TE01 mode and a TE10 mode. The TE01 modes are transmitted to the combining channel from the two side ports of the separation channel, combined into one mode based on the channel structure of the combining channel, and output from the first standard rectangular port of the combining channel. The TE10 mode is transmitted from the through port of the separation channel to the matching channel and output from the second standard rectangular port of the matching channel.

In addition, the separation channel, the combining channel and the matching channel arranged inside the wideband OMT can also perform opposite electromagnetic wave transmission, that is, the TE10 mode is input from the second standard rectangular port of the matching channel and enters the separation channel through the through port. The TE01 mode is input from the first standard rectangular port of the combining channel and enters the separation channel through the two side ports. At this time, the TE01 mode and the TE10 mode are combined in the separation channel and output through the common port.

It is to be noted that in this disclosure, in order to describe the internal channel structure of the ultra-wideband Ortho-Mode Transducer clearly, the first channel of the ultra-wideband Ortho-Mode Transducer is divided into a separation channel, a combining channel and a matching channel. However, the specific division manner for the internal channel (first channel) of the ultra-wideband Ortho-Mode Transducer is not specifically limited in this disclosure.

Figure 3:
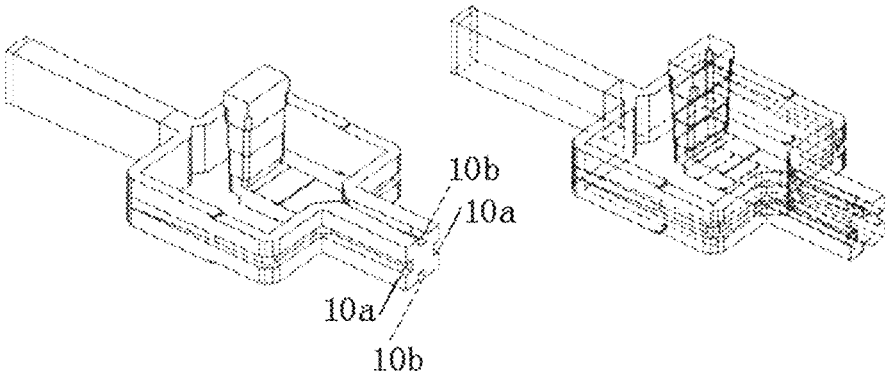
FIG. 3 is a schematic diagram of a first channel of an ultra-wideband Ortho-Mode Transducer in FIG. 1.
Figure 4:
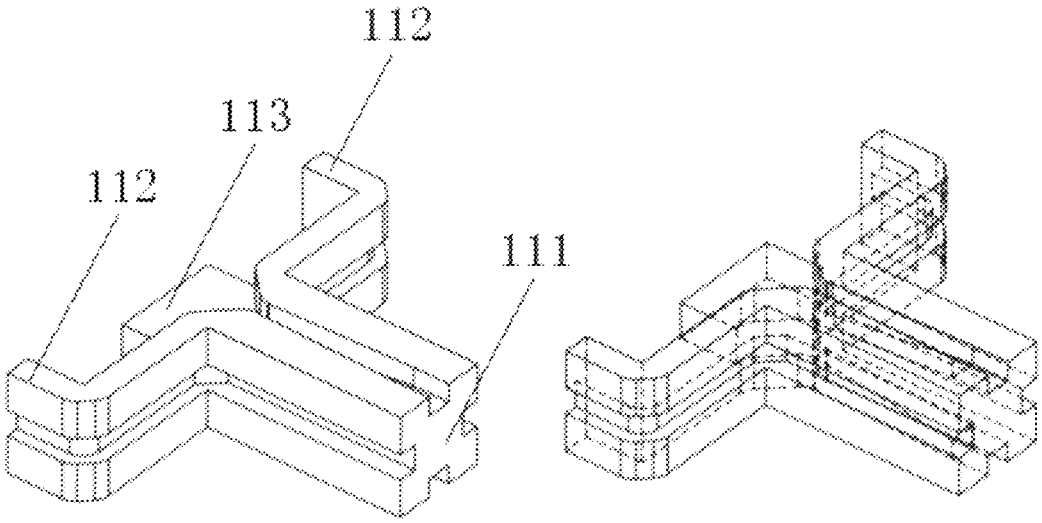
FIG. 4 is a schematic diagram of a separation channel of the first channel in FIG. 3.
Figure 5:
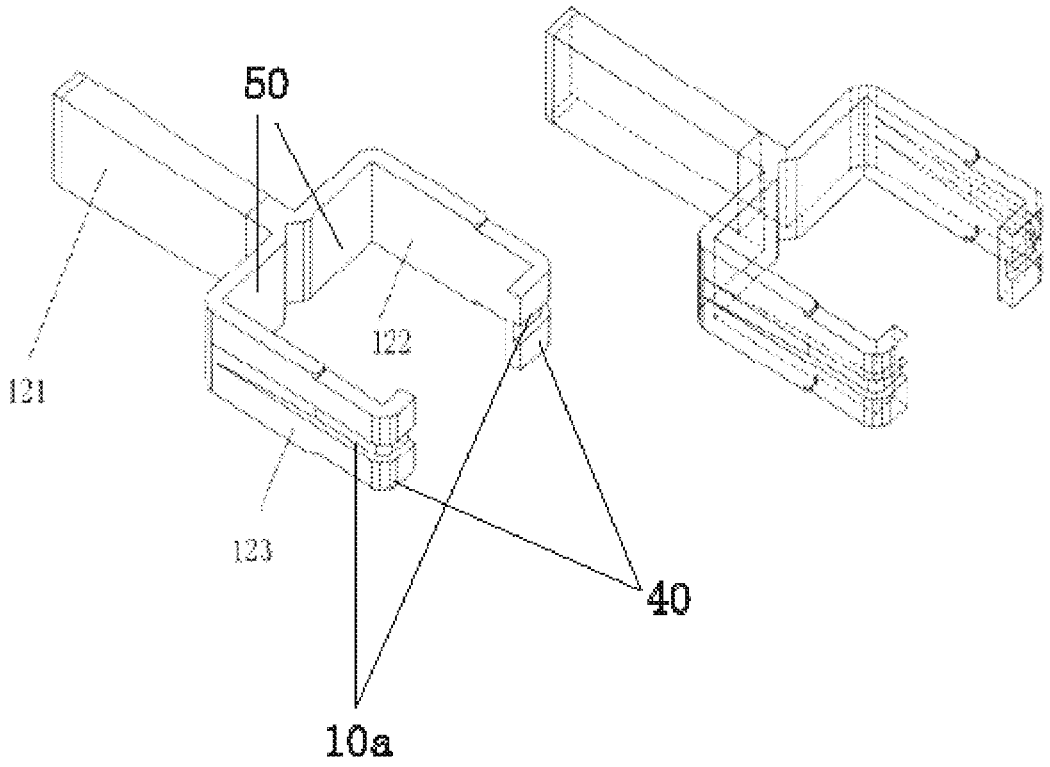
FIG. 5 is a schematic diagram of a combining channel of the first channel in FIG. 3.
Figure 6:
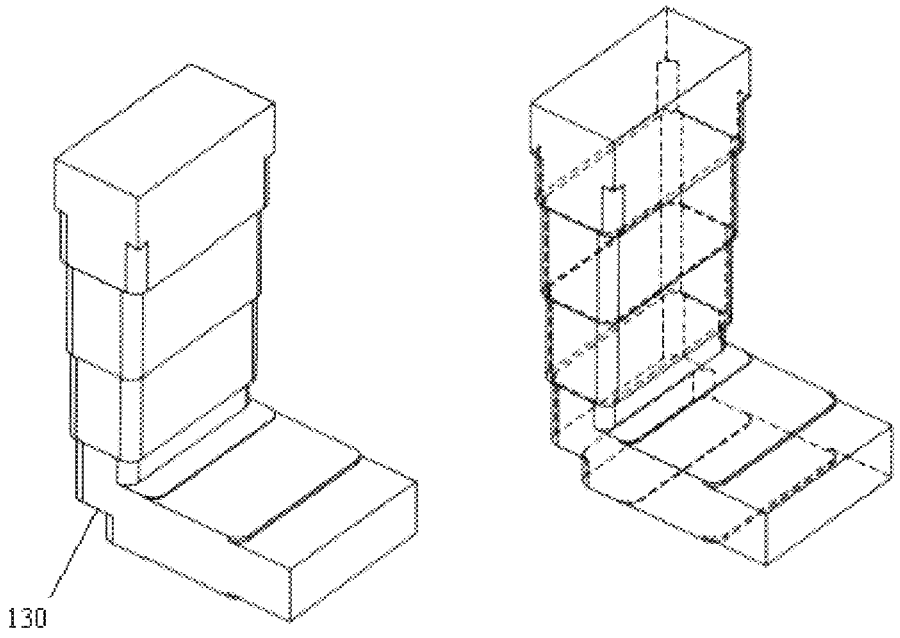
FIG. 6 is a schematic diagram of a matching channel of the first channel in FIG. 3.

The ultra-wideband Ortho-Mode Transducer of this disclosure may be shown in FIG. 3, the separation channel may be shown in FIG. 4, the combining channel may be shown in FIG. 5, and the matching channel may be shown in FIG. 6. It is to be noted that FIGS. 3-6 are internal channel models of the ultra-wideband Ortho-Mode Transducer, rather than an ultra-wideband Ortho-Mode Transducer solid model.

The common port of this disclosure may be a square quad-ridged waveguide port with a side length of 5.9 mm, and may be connected to the radiation antenna. The standard rectangular port may be a BJ320 standard rectangular port, and may be connected to a waveguide coaxial converter. The through port may be a rectangular waveguide of 6.6 mm*2.1 mm. The side port may be a single-ridge waveguide port of 5.9 mm*1.56 mm.

In an optional embodiment, the four ridges are divided into a first group of ridges and a second group of ridges; two ridges of the first group of ridges are located on a first side wall and a second side wall respectively and extends to the combining channel, the first side wall and the second side wall are opposite walls of the separation channel; two ridges of the second group of ridges are located on a third side wall and a fourth side wall respectively, the third side wall and the fourth side wall are opposite walls of the separation channel.

That is, as shown in FIG. 4, the four ridges are a first ridge, a second ridge, a third ridge, and a fourth ridge, respectively. The first ridge and the second ridge form the first group of ridges, and the third ridge and the fourth ridge form the second group of ridges. At this time, the first ridge is arranged on a first side wall of the separation channel, and extends to the combining channel based on the side port connected to the first side wall. The second ridge is arranged on a second side wall of the separation channel, and extends to the combining channel based on the side port connected to the second side wall. The first side wall and the second side wall are opposite walls of the separation channel. Optionally, the third ridge and the fourth ridge are arranged on a third side wall and a fourth side wall, the third side wall and the fourth side wall are opposite walls of the separation channel.

In an optional embodiment, as shown in FIG. 5, the combining channel includes a combining sub-channel, a first conversion sub-channel and a second conversion sub-channel. A first end of the first conversion sub-channel and a first end of the second conversion sub-channel are connected to the two side ports of the separation channel respectively, and a second end of the first conversion sub-channel and a second end of the second conversion sub-channel are both connected to the combining sub-channel.

It is to be noted that in order to clearly describe the channel structure of the combining channel in this disclosure, the combining channel of the ultra-wideband Ortho-Mode Transducer is divided into a combining sub-channel, a first conversion channel and a second conversion channel. That is, the specific division manner for the combining channel is not specifically limited in this disclosure.

In some embodiments, in a direction of close to the combining sub-channel, a height of each ridge of the first group of ridges gradually decreases in the first conversion channel and the second conversion channel, so that the first conversion channel transits smoothly from a single-ridge waveguide to a rectangular waveguide, and the second conversion channel transits smoothly from a single-ridge waveguide to a rectangular waveguide. After the first conversion channel transits to the rectangular waveguide and the second conversion channel is converted into the rectangular waveguide, the combining sub-channel connects the two rectangular waveguides so that the two rectangular waveguides are combined into one rectangular waveguide, and then the ultra-wideband Ortho-Mode Transducer outputs electromagnetic waves with the rectangular waveguide.

In an optional embodiment, as shown in FIG. 5, in a direction from the first end to the second end of the first conversion channel, a ridged surface of the first conversion channel is widened from a first preset position, the widening process being to widen a ridged surface of the first conversion channel. In a direction from the first end to the second end of the second conversion channel, a ridged surface of the second conversion channel is widened from a second preset position, the widening process being to widen a ridged surface of the second conversion channel.

For example, it is assumed that the ridged surface of the first conversion channel is surface A. At this time, in the direction from the first end to the second end of the first conversion channel, the surface. A is widened from a first preset position.

In an optional embodiment, as shown in FIG. 5, when the cross section of the combining sub-channel is T-shaped, a V-shaped ridge is arranged at a T-shaped node of the combining sub-channel. The V-shaped ridge is arranged along a depth direction to form a V-shaped gap of the combining sub-channel. The ridge surface angle of the V-shaped ridge is 45°.

In an optional embodiment, in a direction extending from the common port to the inside of the first channel, a height of each ridge of the second group of ridges gradually increases from a third preset position until a ridge pitch between the two ridges of the second group of ridges becomes a first threshold, the first threshold is a cross-sectional width of the through port of the separation channel.

Figure 7:
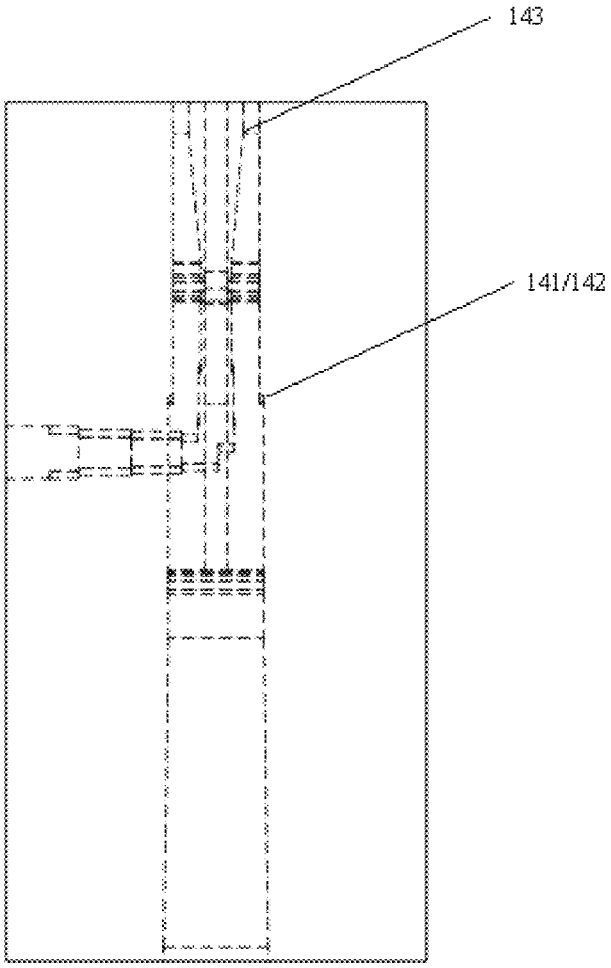
FIG. 7 is a side perspective view of an ultra-wideband Ortho-Mode Transducer in FIG. 1.

That is, as shown in FIG. 4, the second group of ridges penetrate through a third surface and a fourth surface of the separation channel, and gradually increase the ridge heights from a third preset position so that after the separation channel subsequently separates the two side ports, a through port with the length greater than the width is formed. As shown in FIG. 7, the third ridge and the fourth ridge gradually increase the ridge heights from the third preset position, so as to gradually compress the broadside size of the through port in the structure.

In an optional embodiment, as shown in FIG. 8, in a direction extending from the common port to the inside of the first channel, the second group of ridges gradually decreases the ridge width from a fourth preset position until the ridge width of the second group of ridges becomes a second threshold. The second threshold is related to a frequency band corresponding to the ultra-wideband Ortho-Mode Transducer. For example, as the frequency corresponding to the ultra-wideband Ortho-Mode Transducer is higher, the second threshold is larger.

Figure 9:
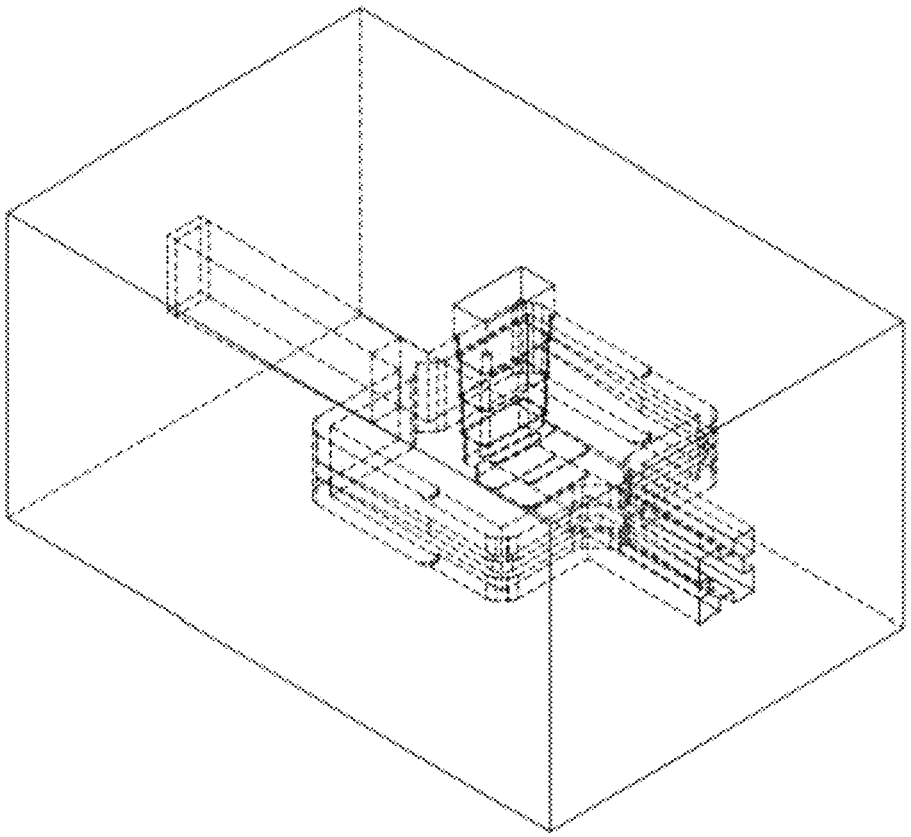
FIG. 9 is a three-dimensional perspective view of an ultra-wideband Ortho-Mode Transducer in FIG. 1.

It is to be noted that the ridge width, and ridge height of the second group of ridges change at the same time, and the decrease processing and increase processing is started. Specifically, as shown in FIG. 7, FIG. 8 and FIG. 9, the third preset position and the fourth preset position may be the same position, and when the second group of ridges begins to gradually increase the ridge height, this group of ridges also begin to gradually decrease the ridge width at the same time.

It is to be noted that the ridge width and ridge height of the second group of ridges satisfy the preset conditions at the same time, and the decrease processing and increase processing is stopped. Specifically, as shown in FIG. 7, FIG. 8 and FIG. 9, the second group of ridges begins to gradually increase the ridge height and gradually decrease the ridge width from the same position. Optionally, the ridge height of the second group of ridges gradually satisfies the preset conditions and no longer increase, and the ridge width of the second group of ridges gradually satisfies the preset conditions and no longer decrease. At this time, the ridge width and ridge height of the second group of ridges satisfy the preset conditions and no longer change at the same position.

In an optional embodiment, after the ridge pitch between the first ridge and the second ridge of the second group of ridges becomes the first threshold, the separation channel begins to form two side ports; or, after the ridge width of each ridge in the second group of ridges becomes the second threshold, the separation channel begins to form two side ports, or, after the ridge width of each ridge in the second group of ridges becomes the second threshold and after the ridge pitch between the first ridge and the second ridge of the second group of ridges becomes the first threshold, the separation channel begins to form two side ports.

That is, in the embodiment of this disclosure, after the ridge pitch between the third ridge and the fourth ridge included in the second group of ridges becomes the first threshold, the separation channel begins to form two side ports; or, after the ridge width of each ridge in the second group of ridges becomes the second threshold, the separation channel begins to form two side ports; or, after the ridge pitch between the third ridge and the fourth ridge included in the second group of ridges becomes the first threshold and the ridge width of each ridge in the second group of ridges becomes the second threshold, the separation channel may begin to form two side ports.

Specifically, after the ridge pitch of the two ridges of the second group of ridges becomes the first threshold, ridge side walls of each ridge of the second group of ridges are gradually separated at a preset angle until the distance between the ridge side walls of each ridge becomes a third threshold, After the distance between the ridge side walls of each ridge becomes the third threshold, the ridge side walls are combined in pairs and transformed into side walls of the two side ports of the separation channel. It is to be noted that the preset angle is preferably 45°.

That is, as shown in FIG. 4, the ridge side walls of the third ridge of the second group of ridges are gradually separated until they become part of the side walls of the two side ports of the separation channel, and the ridge side walls of the fourth ridge of the second group of ridges are gradually separated until they become part of the side walls of the two side ports of the separation channel. It is assumed that the ridge side walls of the third ridge are a first ridge side wall and a second ridge side wall respectively, and the ridge side walls of the fourth ridge are a third ridge side wall and a fourth ridge side wall respectively. At this time, the first ridge side wall and the third ridge side wall are joined together from a side surface of the through port to form a side wall of the side port. The second ridge side wall and the fourth ridge side wall are joined together from a side surface of the through port to form a side wall of the other side port.

In an optional embodiment, after the ridge pitch of the two ridges of the second group of ridges becomes the first threshold, a first side surface and a second side surface of the separation channel are turned at right angles to transform into the side walls of the two side ports of the separation channel, a longitudinal section of the first side surface and a longitudinal section of the second side surface are L-shaped.

Specifically, as shown in FIG. 4, after the distance between the third ridge and the fourth ridge becomes the first threshold in this disclosure, the first side surface and the second side surface of the separation channel begin to be turned at right angles. The first side surface and the second side surface of the separation channel is turned at right angles after a preset length, so that a width and a length of the cross section of the side port after turning satisfy second preset conditions. For example, the width of the cross section of the side surface after conversion is 1.56 mm, and the length is 5.9 mm.

In an optional embodiment, the matching channel smoothly transits the through port of the separation channel to a standard rectangular port based on a staircase structure. A broadside size of each step in the staircase structure meets the Chebyshev impedance transformation. In addition, the matching channel is turned at a right angle at a first position, and a stepped structure is arranged on the outside of the first position, as shown in FIG. 6.

In summary, the common port in the ultra-wideband Ortho-Mode Transducer in this disclosure adopts a 4-ridge structure, and a full-ridge waveguide design is adopted at a mode separation part. Further, the double-ridge waveguide is transited to a non-standard rectangular waveguide near the through port, and the non-standard rectangular waveguide is transited to a standard rectangular waveguide through step impedance matching. Two branch side ports are transited from the single-ridge waveguide to the non-standard rectangular waveguide. The above quad-ridge structure enables the ultra-wideband Ortho-Mode Transducer to have a wider operating bandwidth and a higher port isolation, realize multiple octave, have a good impedance matching, a higher isolation and a higher polarization purity, and a lower processing difficulty.

In addition, the ultra-wideband Ortho-Mode Transducer provided in this disclosure may be formed by a plurality of components, that is, the plurality of components are superimposed and spliced to form the first channel.

It is worth noting that each ridge in the ultra-wideband Ortho-Mode Transducer is completely arranged on one component. The operation that each ridge is completely arranged on one component means that: assuming that the ultra-wideband Ortho-Mode Transducer includes a first ridge, a second ridge, a third ridge, and a fourth ridge, the first ridge is completely arranged on a component, the second ridge is completely arranged on a component, the third ridge is completely arranged on a component, and the fourth ridge is completely arranged on a component.

Figure 10:
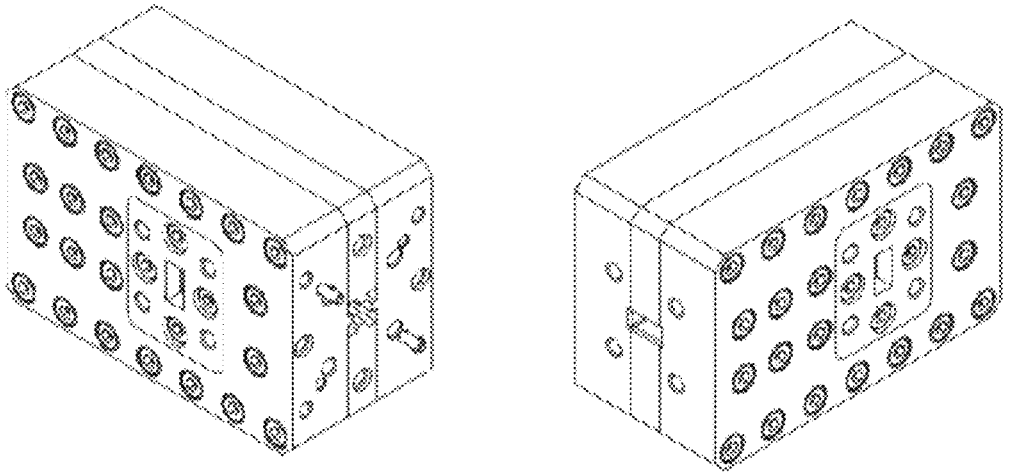
FIG. 10 is a schematic assembly diagram 1 of an ultra-wideband Ortho-Mode Transducer in FIG. 1.
Figure 11:
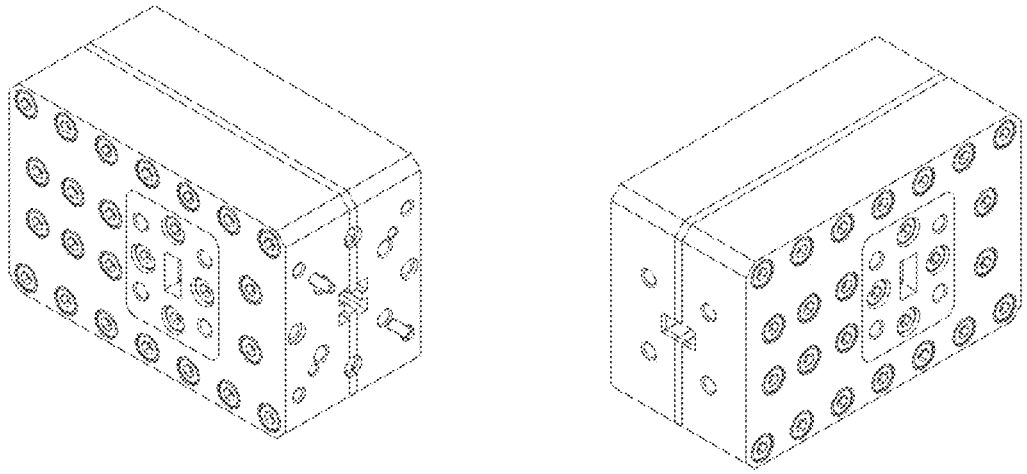
FIG. 11 is a schematic assembly diagram 2 of an ultra-wideband Ortho-Mode Transducer in FIG. 1.
Figure 12:
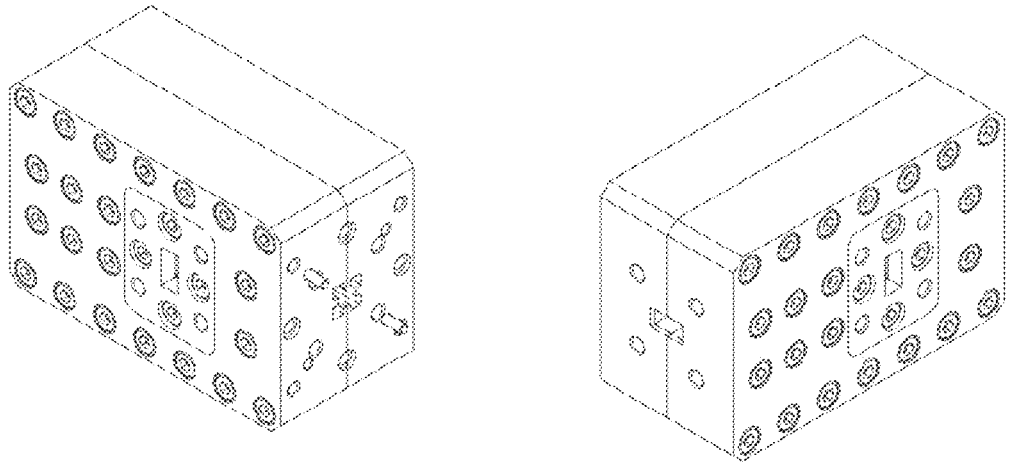
FIG. 12 is a schematic assembly diagram 3 of an optional ultra-wideband Ortho-Mode Transducer according to this disclosure.
Figure 13:
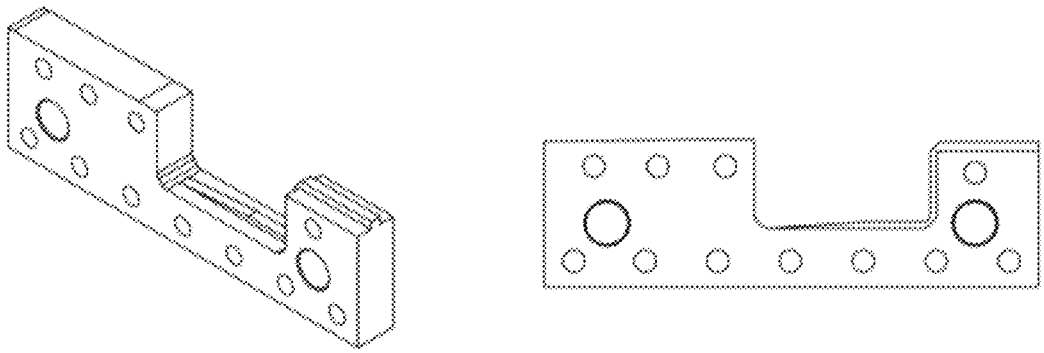
FIG. 13 is a schematic diagram of an optional first/second component according to this disclosure.

In some embodiments, as shown in FIG. 10 and FIG. 11, the ultra-wideband Ortho-Mode Transducer comprises three groups of components which are stacked on after the other to form the mode separation cavity, the combining cavity and the matching cavity. The first ridge and the second ridge are completely arranged in a target component group, and the target component group is a component group located in an intermediate position of the three component groups. This arrangement manner prevents combination gaps between the components from being arranged on the ridge, resulting in the situation that the gaps on the ridge cannot be effectively combined and sealed. Specifically, as shown in FIG. 12, if the combined gap between the components is arranged on the ridge, based on the internal cavity structure of the ultra-wideband ortho-mode Transducer, it will not be possible to provide screw fastening members at the ridge, resulting in that the gaps on the ridge cannot be effectively combined and sealed, which affects reduction of the operating stability of the ultra-wideband ortho-mode Transducer It is to be noted that the target component group includes two components side by side, which are a first component and a second component. The first ridge is arranged on the first component, and the second ridge is arranged on the second component, as shown in FIG. 13. In addition, the width of the target component group in the stacked direction can be the ridge height, or the width of the first/second side surface, or any value between the ridge height value and the width value of the first/second side surface, which is not specifically limited in present disclosure.

Figure 14:
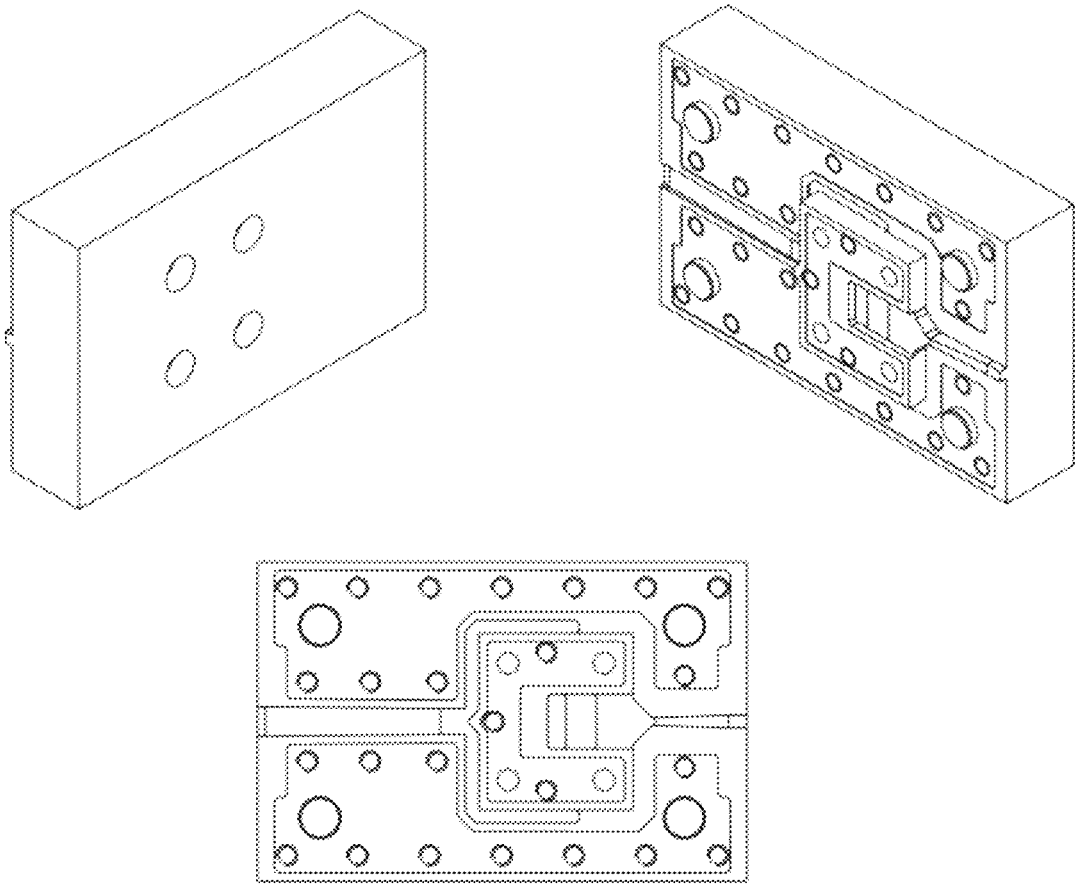
FIG. 14 is a schematic diagram 1 of an optional component according to this disclosure.
Figure 15:
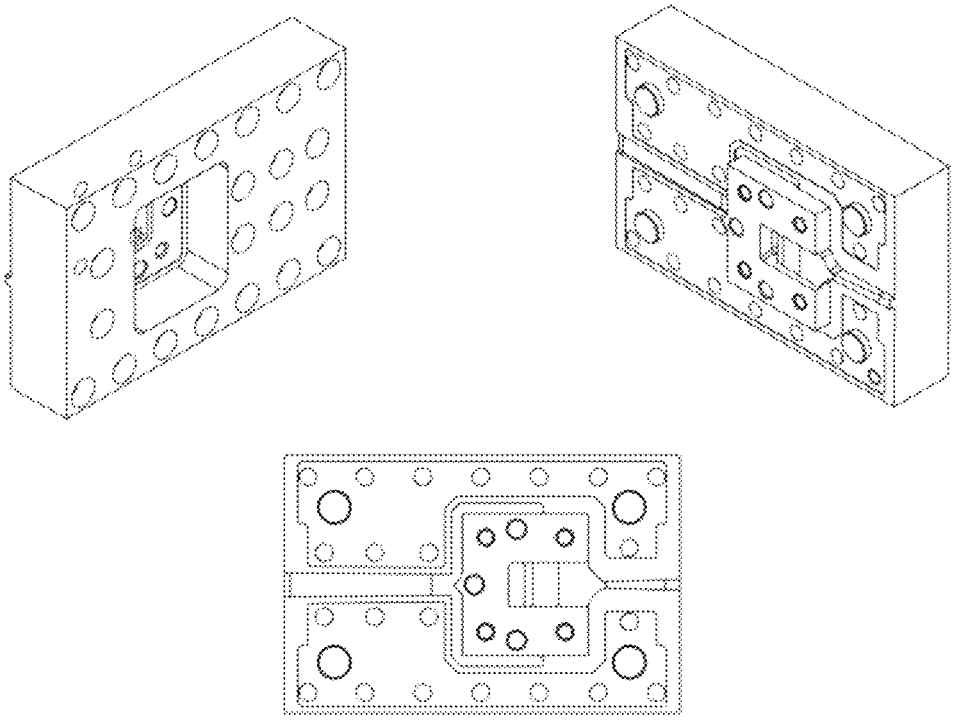
FIG. 15 is a schematic diagram 2 of an optional component according to this disclosure.

In addition, in a case that the ultra-wideband Ortho-Mode Transducer is provided with three groups of components, the components of the other groups except the target group are shown in FIG. 14 and FIG. 15.

In an optional embodiment, in a case that a port shape of the common port does not match a port shape of the first antenna port, the ultra-wideband Ortho-Mode Transducer further includes a port transition device. The port transition device comprises a third channel inside, A first transition port of the third channel is connected to the common port, and a port shape of the first transition port matches the port shape of the common port. A second transition port of the third channel is connected to the first antenna port of the radiation antenna, and a port shape of the second transition port matches the port shape of the first antenna port. The third channel is configured to smoothly transit the first transition port into the second transition port.

In another optional embodiment, in a case that a port shape of the common port does not match a port shape of the first antenna port, the radiation antenna further includes a port transition device. The port transition device comprises a third channel inside. A first transition port of the third channel is connected to the common port of the ultra-wideband Ortho-Mode Transducer, and a port shape of the first transition port matches the port shape of the common port. A second transition port of the third channel is connected to the first antenna port, and a port shape of the second transition port matches the port shape of the first antenna port. The third channel is configured to smoothly transit the first transition port into the second transition port.

That is, in the case that the port shape of the common port does not match the port shape of the first antenna port, the ultra-wideband Ortho-Mode Transducer includes the port transition device, so that the common port of the ultra-wideband Ortho-Mode Transducer may smoothly transit to the port shape of a first antenna port of the radiation antenna, and then naturally connected to the first antenna port; or the radiation antenna includes the port transition device, so that the first antenna port of the radiation antenna may smoothly transit to the port shape of the common port of the ultra-wideband Ortho-Mode Transducer, and then naturally connected to the common port.

It is to be noted that the port transition device included in the ultra-wideband Ortho-Mode Transducer is the same as the port transition device included in the radiation antenna.

It is to be noted that the common port of the ultra-wideband Ortho-Mode Transducer in this disclosure is a quad-ridge square port, so if the port shape of the first antenna port of the radiation antenna does not match the quad-ridge square port, the ultra-wideband Ortho-Mode Transducer or the radiation antenna needs to be configured with the port transition device.

Figure 16:
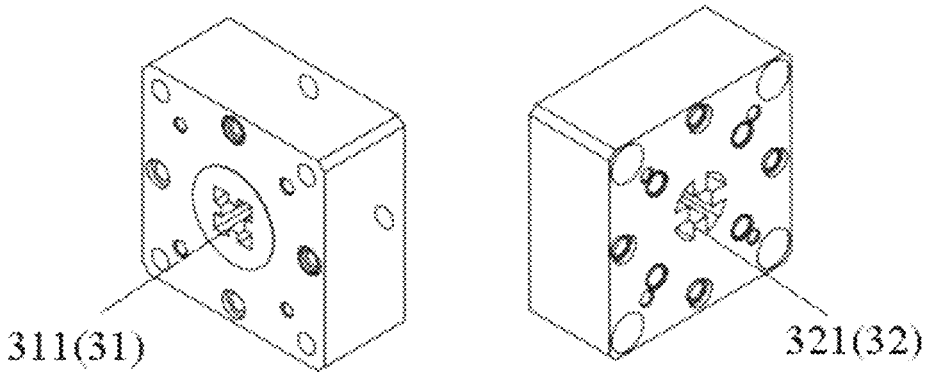
FIG. 16 is a schematic diagram 1 of a port transition device according to this disclosure.
Figure 17:
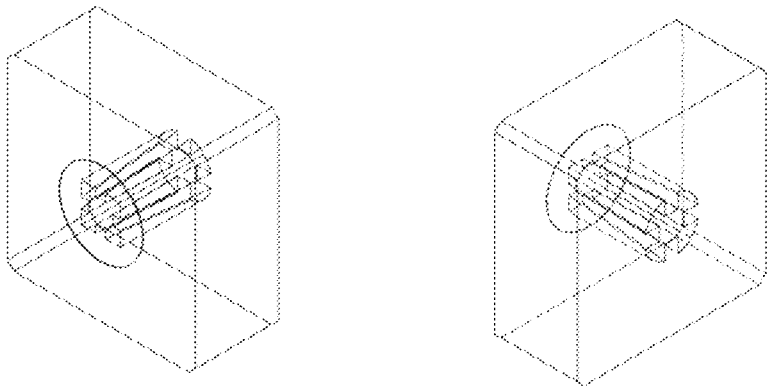
FIG. 17 is a perspective diagram 1 of a port transition device according to this disclosure.

In some embodiments, the port shape of the first antenna port of the radiation antenna is a quad-ridge circular port. and the first transition port of the port transition device should be quad-ridge square port, and a port shape of the quad-ridge square port matches the port shape of the common port. The second transition port is a quad-ridge circular port, and a port shape of the quad-ridge circular port matches the port shape of the first antenna port. The quad-ridge circular port is formed by uniformly arranging four ridges with a square cross-section on an inner wall of the circular port, as shown in FIG. 16 and FIG. 17.

Figure 18:
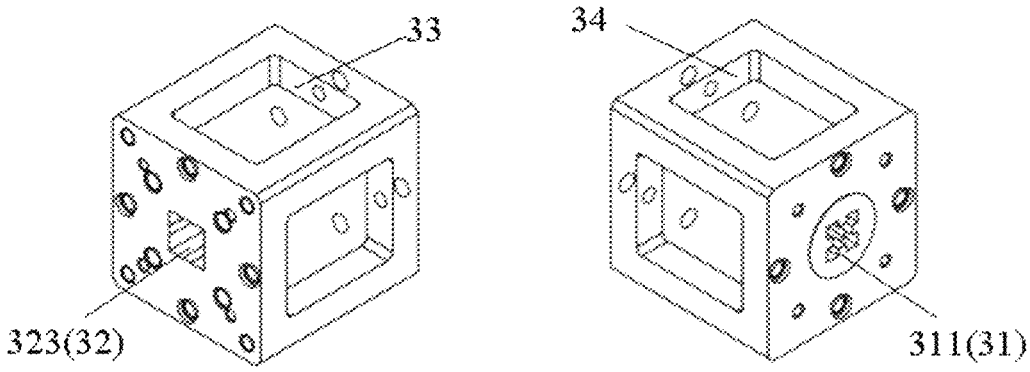
FIG. 18 is a schematic diagram 2 of a port transition device according to this disclosure.
Figure 19:
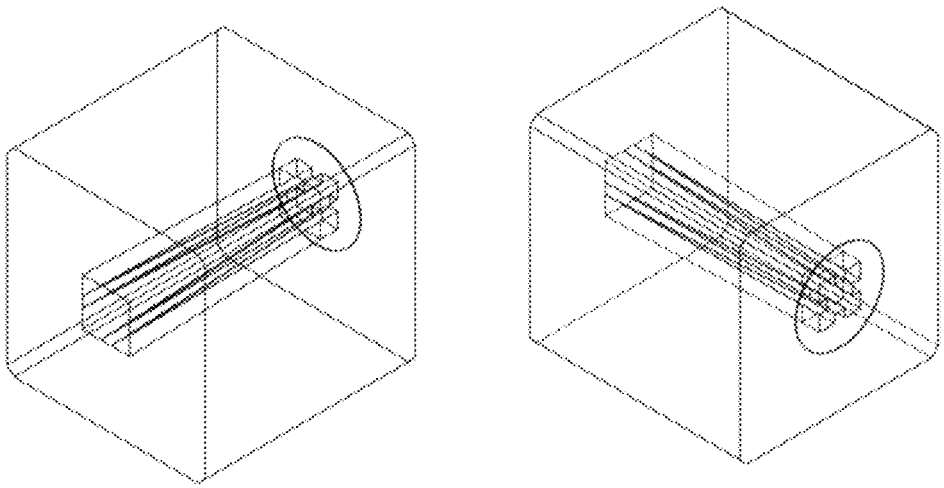
FIG. 19 is a perspective view 2 of a port transition device according to this disclosure.

In some embodiments, the first antenna port of the radiation antenna is a square port without the ridge. The port transition device should be a quad-ridge square port, and a port shape of the quad-ridge square port matches the port shape of the common port. The second transition port is a first square, port, and a port shape of the first square port matches the port shape of the first antenna port. The first square port is a square port without a ridge on an inner wall, as shown in FIG. 18 and FIG. 19.

In some embodiments, the first antenna port of the radiation antenna is a circular port without a ridge. The port shape of the first transition port of the port transition device should be a quad-ridge square port, and a port shape of the quad-ridge square port matches the port shape of the common port. The second transition port of the port transition device is a first circular port, and a port shape of the first circular port matches the port shape of the first antenna port. The first circular port is a circular port without a ridge on an inner wall.

Figure 20:
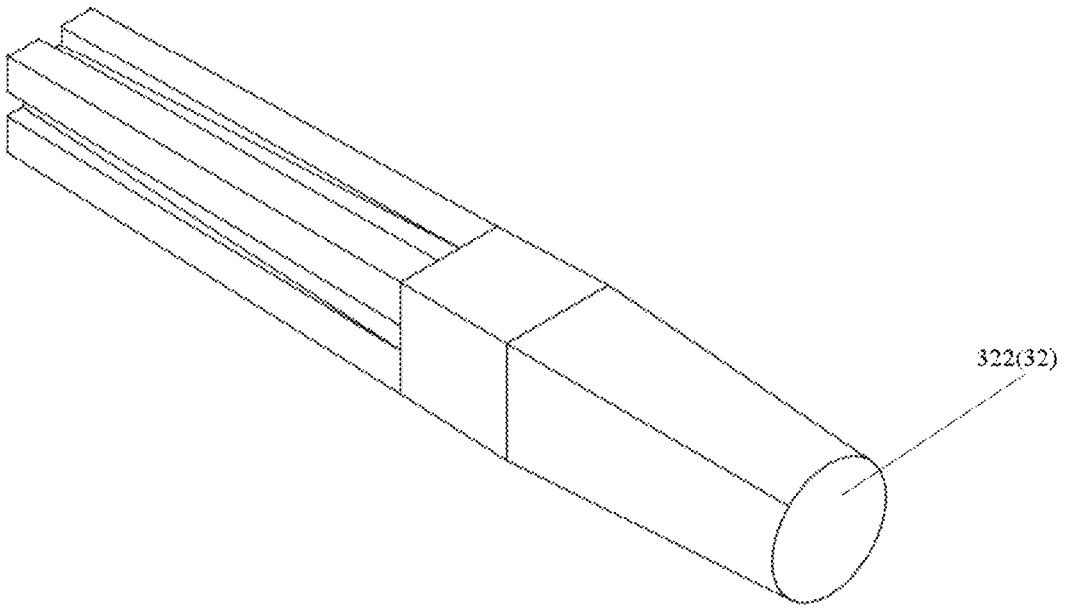
FIG. 20 is a schematic diagram of a third channel in a port transition device according to this disclosure.

It is to be noted that the above content in this disclosure is merely some embodiments, and does not limit the port transition mode. For example, in the case that the first transition port is the quad-ridge square port and the second transition port is the first circular port, the transition path is as shown in FIG. 20. That is, the first transition port is first transit from a quad-ridge square port to a square port with a smaller side length, from a square port with a smaller side length to a square port with a larger side length, and then from a square port with a larger side length to the first circular port, etc., which is not specifically limited by the applicant.

In addition, a first fixed portion is arranged on an outer periphery of the first transition port of the port transition device. The first fixed portion is configured to connect the port transition device and the ultra-wideband Ortho-Mode Transducer. Moreover, a second fixed portion is arranged on an outer periphery of the second transition port of the port transition device. The second fixed portion is configured to connect the port transition device and the radiation antenna, as shown in FIG. 16 and FIG. 18.

In some embodiments, as shown in FIG. 16 and FIG. 18, the outer periphery of the first transition port is expanded to form a platform-like first fixed portion. The first fixed portion is provided with at least one screw hole. In addition, the ultra-wideband Ortho-Mode Transducer is also provided with at least one screw hole on the periphery of the common port, the screw hole corresponding to the screw hole on the first fixed portion. At this time, the two screw holes are connected by a nut to fix the port transition device on the ultra-wideband Ortho-Mode Transducer.

Figure 21:
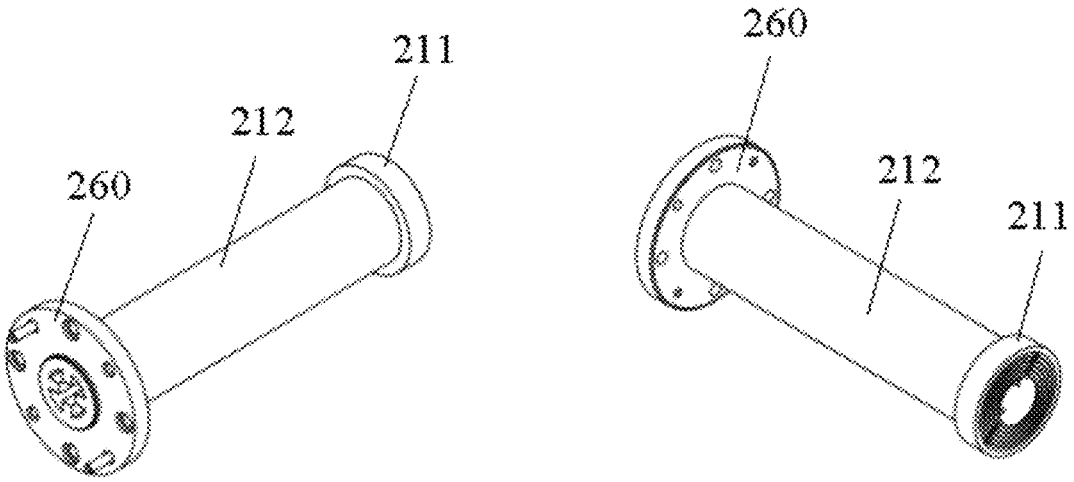
FIG. 21 is a schematic diagram 1 of a radiation antenna according to this disclosure.
Figure 22:
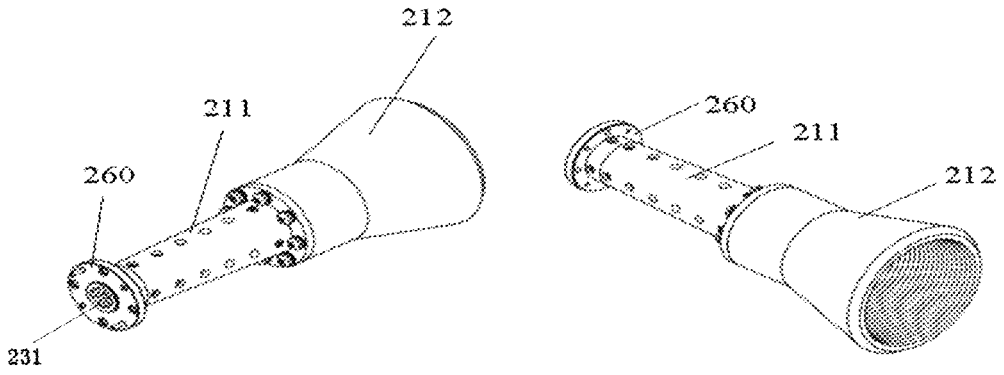
FIG. 22 is a schematic diagram 2 of a radiation antenna according to this disclosure.
Figure 23:
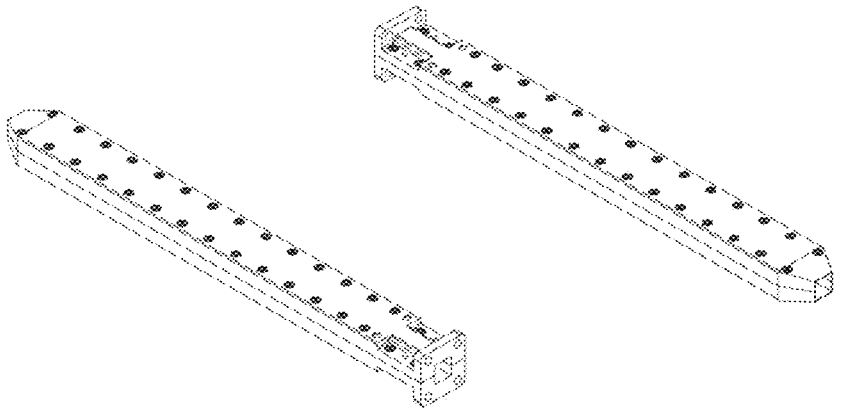
FIG. 23 is a schematic diagram 3 of a radiation antenna according to this disclosure.
Figure 24:
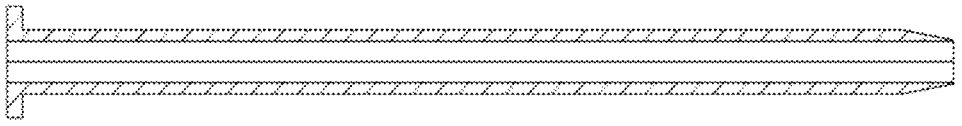
FIG. 24 is a side view and a cross-sectional view of the radiation antenna in FIG. 23.
Figure 25:
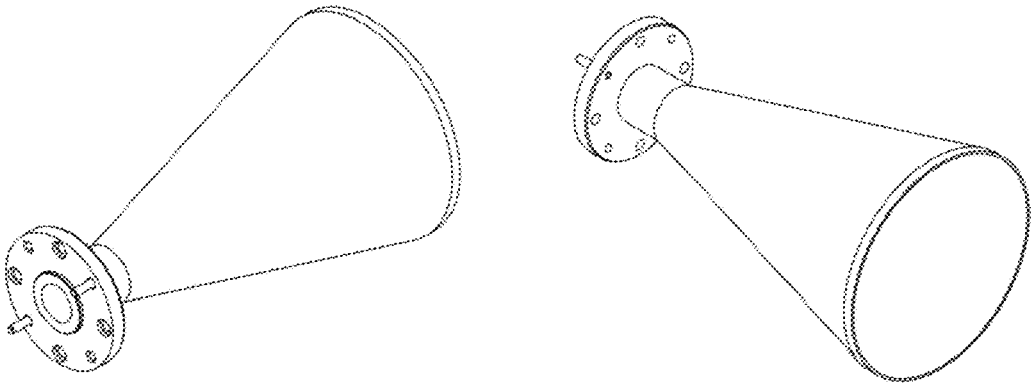
FIG. 25 is a schematic diagram 4 of a radiation antenna according to this disclosure.
Figure 26:
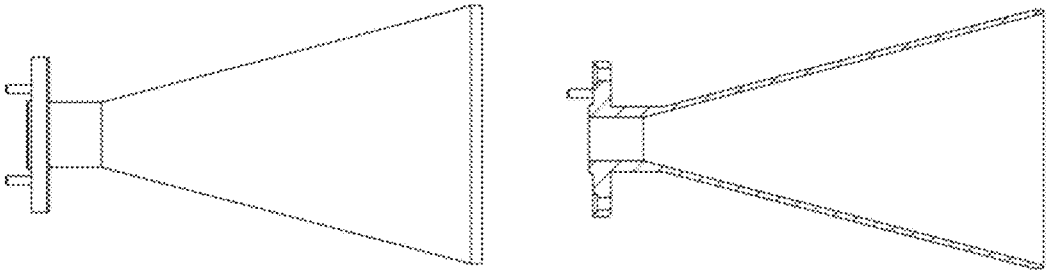
FIG. 26 is a side view and a cross-sectional view of the radiation antenna in FIG. 25.

For the radiation antenna, it is to be noted that:

the radiation antenna of this disclosure is any feasible antenna in the prior art, for example, a quad-ridge corrugated horn as shown in FIG. 21, another quad-ridge corrugated horn as shown in FIG. 22, an open ended waveguide probe antenna body as shown in FIG. 23 and FIG. 24, a dual polarization conical horn as shown in FIG. 25 and FIG. 26, etc., which may not be specifically limited in this disclosure.

Figure 27:
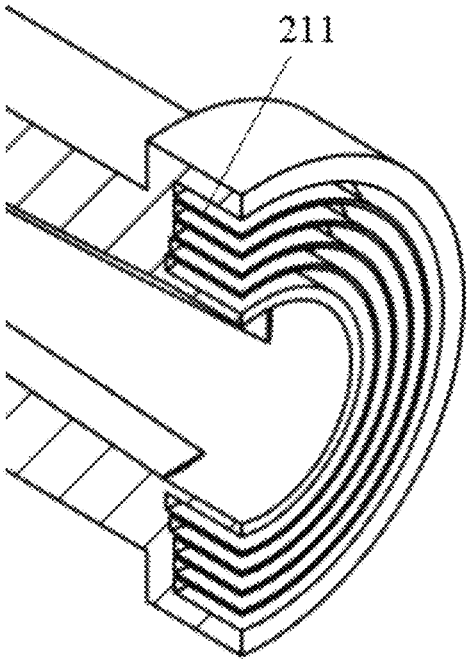
FIG. 27 is a cross-sectional view of a horn portion of the radiation antenna in FIG. 21.

For the quad-ridge corrugated horn shown in FIG. 21, it is to be noted that:

In an optional embodiment, as shown in FIG. 27, the radiation antenna is divided into a transition portion and a horn caliber surface portion along an electromagnetic wave transmission direction, and the horn caliber surface portion is provided with multiple grooves. The grooves are concentric circular grooves. The concentric circular grooves are provided on a top surface of the horn caliber surface portion. Specifically, the multiple concentric circular grooves are arranged at equal intervals on the outer periphery of the second antenna port.

Figure 28:
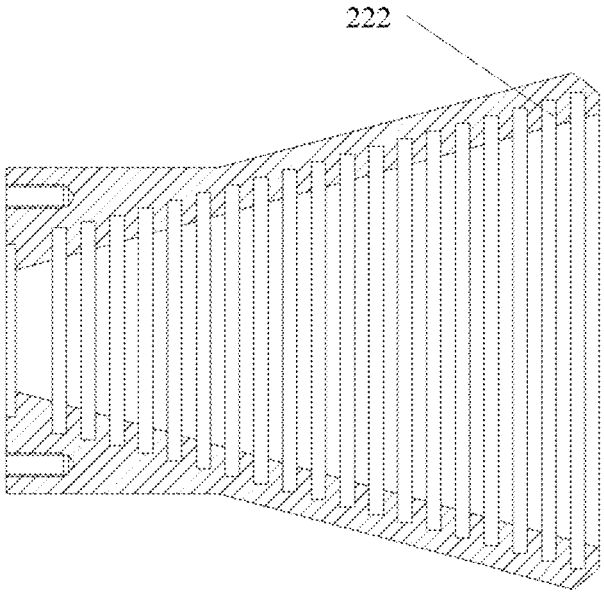
FIG. 28 is a cross-sectional view of a horn portion of the radiation antenna in FIG. 22.

For the quad-ridge corrugated horn shown in FIG. 22, it is to be noted that:

In an optional embodiment, as shown in FIG. 28, the radiation antenna is divided into a transition portion and a horn caliber surface portion along an electromagnetic wave transmission direction, and the horn caliber surface portion is provided with multiple grooves. The annular grooves are arranged along an inner wall of the second channel of the horn caliber surface portion. Specifically, the multiple annular grooves are arranged side by side on the inner wall of the second channel along an electromagnetic wave transmission direction.

It is to be noted that the first antenna port is a port of the second channel away from the horn caliber surface portion, and the second antenna port is a port of the second channel near the horn caliber surface portion. The second channel of the transition portion is a first antenna channel, and the channel located on the horn caliber surface portion is a second antenna channel.

Optionally, for the quad-ridge corrugated horn shown in FIG. 21 and FIG. 22, it is also to be noted that:

in an optional embodiment, in a direction from the first antenna port to the second antenna port, the radiation antenna satisfies at least one of following:

a channel diameter of the first antenna channel remains unchanged or increases gradually, a channel diameter of the second antenna channel remains unchanged or increases gradually.

That is, in a direction from the transition portion to the horn caliber surface portion, the channel diameter of the first antenna channel gradually increases, and the channel diameter of the second antenna channel also gradually increases; or in a direction from the transition portion to the horn caliber surface portion, the channel diameter of the first antenna channel gradually increases, and the channel diameter of the second antenna channel remains unchanged; or in a direction from the transition portion to the horn caliber surface portion, the channel diameter of the first antenna channel remains unchanged, and the channel diameter of the second antenna channel gradually increases; or in a direction from the transition portion to the horn caliber surface portion, the channel diameter of the first antenna channel remains unchanged, and the channel diameter of the second antenna channel also remains unchanged.

Figure 29:
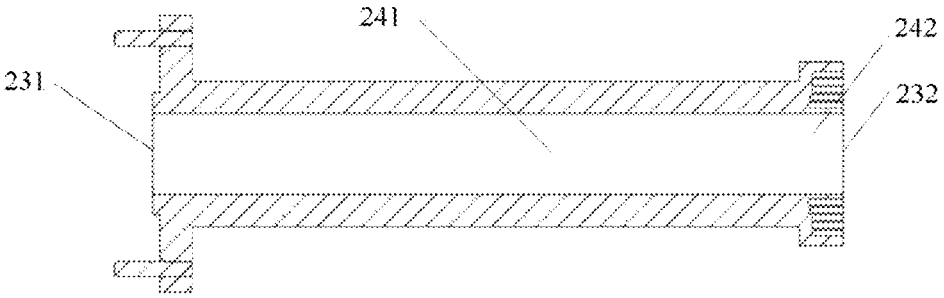
FIG. 29 is a cross-sectional view of the radiation antenna in FIG. 21.
Figure 30:
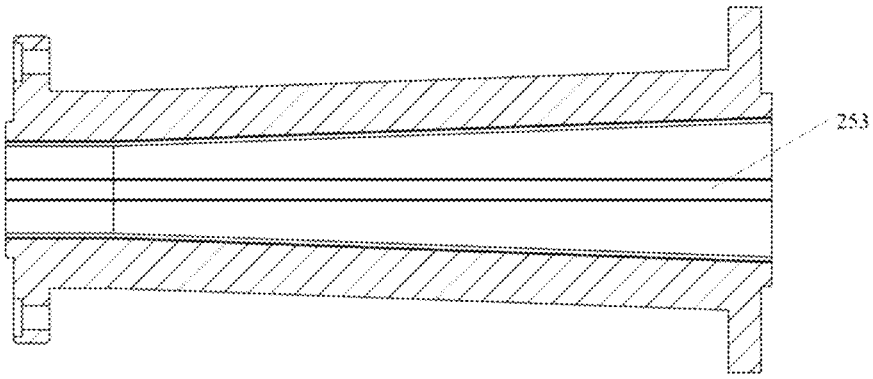
FIG. 30 is a cross-sectional view of a transition portion (without a ridge) of the radiation antenna in FIG. 22.

In some embodiments, the channel diameter of the first antenna channel remains unchanged as shown in FIG. 29, and the channel diameter of the first antenna channel gradually increases as shown in FIG. 30. The channel diameter of the second antenna channel remains unchanged as shown in FIG. 29, and the channel diameter of the third antenna channel gradually increases as shown in FIG. 28.

It is to be noted that the gradual increase of the channel diameter of the first channel and the second channel means linear increase.

In an optional embodiment, a plurality of ridges of antenna with a square cross-section are arranged side by side at equal intervals in the first antenna channel, and the ridges on the inner wall of the first antenna channel bulge into the first antenna channel. There are preferably four ridges of antenna, which are uniformly arranged on the inner wall of the first channel. In a direction from the first antenna port to the second antenna port, the ridge height of the ridges of antenna on the inner wall of the first antenna channel gradually decreases.

Figure 31:
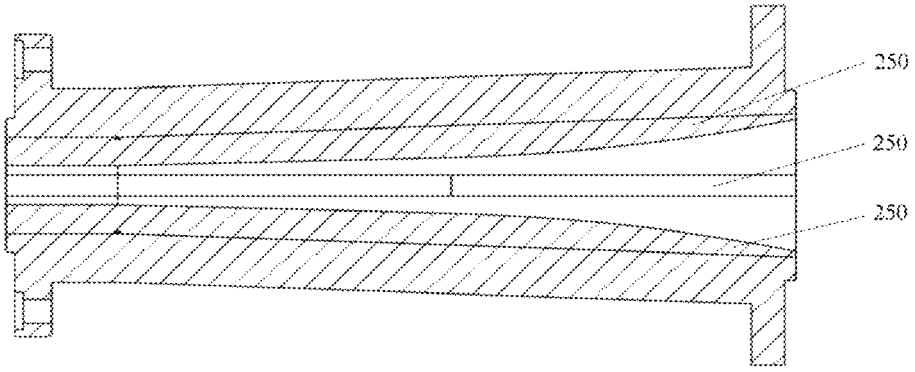
FIG. 31 is a cross-sectional view of a transition portion (with a ridge) of the radiation antenna, in FIG. 22.
Figure 32:
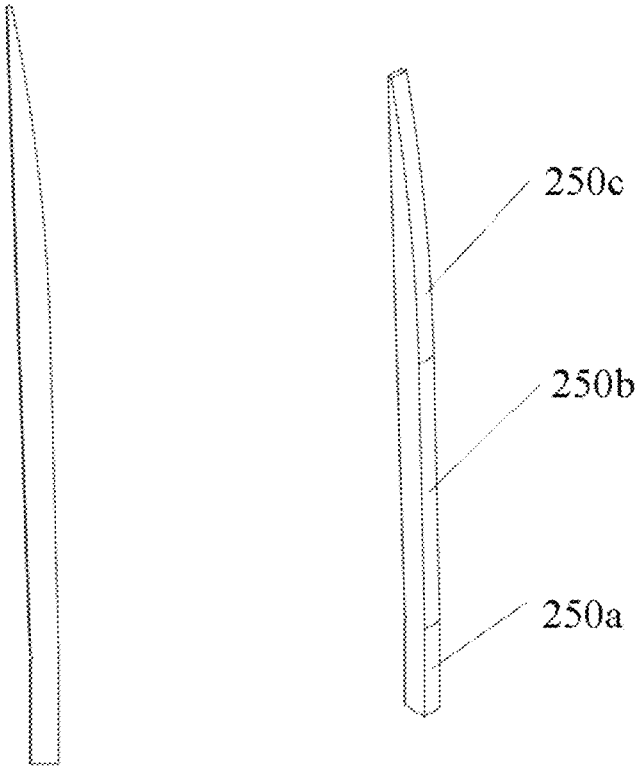
FIG. 32 is a schematic diagram of a ridge in the transition portion of the radiation antenna in FIG. 22.

It is to be noted that the ridge height reduction mode may be linear reduction, curved reduction, or combination of linear and curved reductions. For example, as shown in FIG. 31 and FIG. 32, the antenna ridge arranged on the inner wall of the first antenna channel is divided into a first part, a second part and a third part. The ridge height of the first part is constant, the ridge height of the second part decreases linearly, and the ridge height of the third part decreases curvedly. The curve is preferably an arc with a radius R (for example, an arc with a radius of 180 mm).

In an optional embodiment, in a case that N ridges of antenna are arranged on the inner wall of the first antenna channel, the transition portion of the radiation antenna is provided with N groups of first connecting members, and second connecting members are arranged on bottom surfaces of the N ridges of antenna. The first connecting members and the second connecting members are cooperatively configured to fix the ridges of antenna on the inner wall of the first antenna channel.

Figure 33:
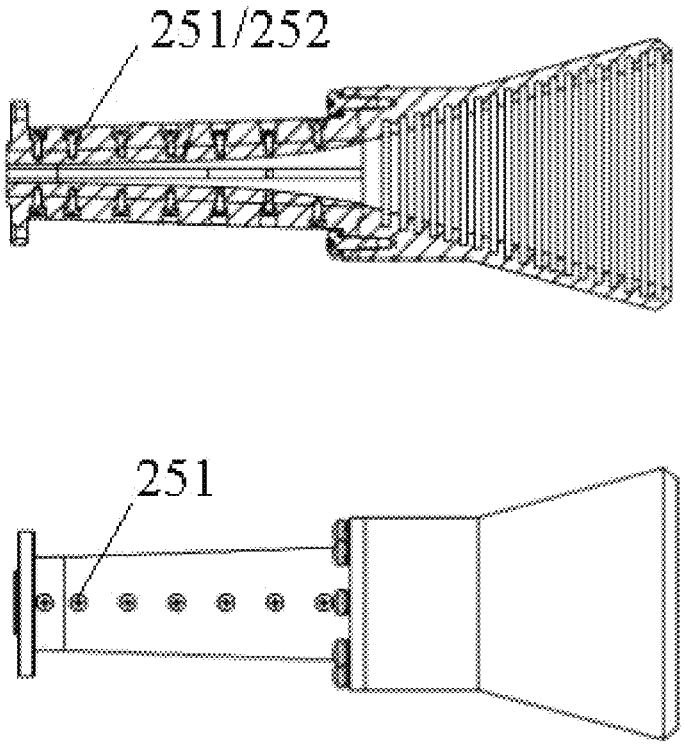
FIG. 33 is a cross-sectional view and a side view of the radiation antenna in FIG. 22.

In an optional embodiment, as shown in FIG. 33, the first connecting member may be a through hole provided on the transition portion, and the second connecting member may be a screw hole provided on the bottom surface of the antenna ridge. A screw passes through the through hole and is connected to the screw hole to further fix the antenna ridge on the inner wall of the first channel. Or, the first connecting member and the second connecting member may also be clamping connecting members that cooperate with each other. The ridge is fixed to the inner wall of the first channel through the clamping connecting member.

In an optional embodiment, in a case that N ridges of antenna are arranged on the inner wall of the first antenna, channel, N positioning grooves are provided on the inner wall of the first antenna channel of the radiation antenna. The positioning grooves and the ridges are arranged in a one-to-one correspondence to position the ridges of antenna into the positioning grooves.

In an optional embodiment, as shown in FIG. 30, FIG. 31 and FIG. 32, positioning grooves are provided on the inner wall of the first channel for mounting ridges of antenna. The antenna ridges are placed in the positioning grooves to restrict the positioning of the ridges of antenna. It is to be noted that in a case that the positioning grooves are provided on the inner wall of the transition portion, the ridge height is still the height of the side wall of the ridges of antenna relative to the inner wall. That is, the ridge height does not include the height of the positioning groove.

In an optional embodiment, the radiation antenna further includes a third fixed portion, the third fixed portion is arranged on an outer periphery of the first antenna port, and the third fixed portion is provided with at least one third connecting member for fixed the radiation antenna.

For embodiment, as shown in FIG. 21, FIG. 22, FIG. 23, FIG. 24, FIG. 25, and FIG. 26, an outer wall of the transition portion is expanded outward at an end away from the horn caliber surface to form a fixed portion. The fixed portion is provided with a third connecting member (for example, multiple through holes and multiple first alignment members). The through holes on the fixed portion are corresponding to the through holes on the ultra-wideband Ortho-Mode Transducer or the port transition device so as to connect the two through holes through a connecting member such as a screw, so that the radiation antenna is fixed on the ultra-wideband Ortho-Mode Transducer or the port transition device. The first alignment member on the fixed portion and a second alignment member on the ultra-wideband Ortho-Mode Transducer or the port transition device are oppositely arranged, so that the first alignment member is inserted into the second alignment member or the first alignment member is inserted into the second alignment member, and the channel of the radiation antenna is aligned and connected with the channel of the ultra-wideband Ortho-Mode Transducer or the port transition device.

In summary, the radiation antenna provided in this disclosure solves the technical problem of a feed antenna with a stable beam width covering a 5G millimeter wave frequency band in the conventional art. A feed antenna with a stable beam width covering a 5G millimeter wave band is provided. The radiation antenna (i.e., a corrugated feed horn antenna) has the following characteristics: symmetric rotation of a radiation pattern, low cross-polarization, and a stable amplitude taper in an operating frequency band. The above characteristics make the radiation antenna very suitable for compact field testing, reflector antennas and other disclosure scenarios.

Figure 34:
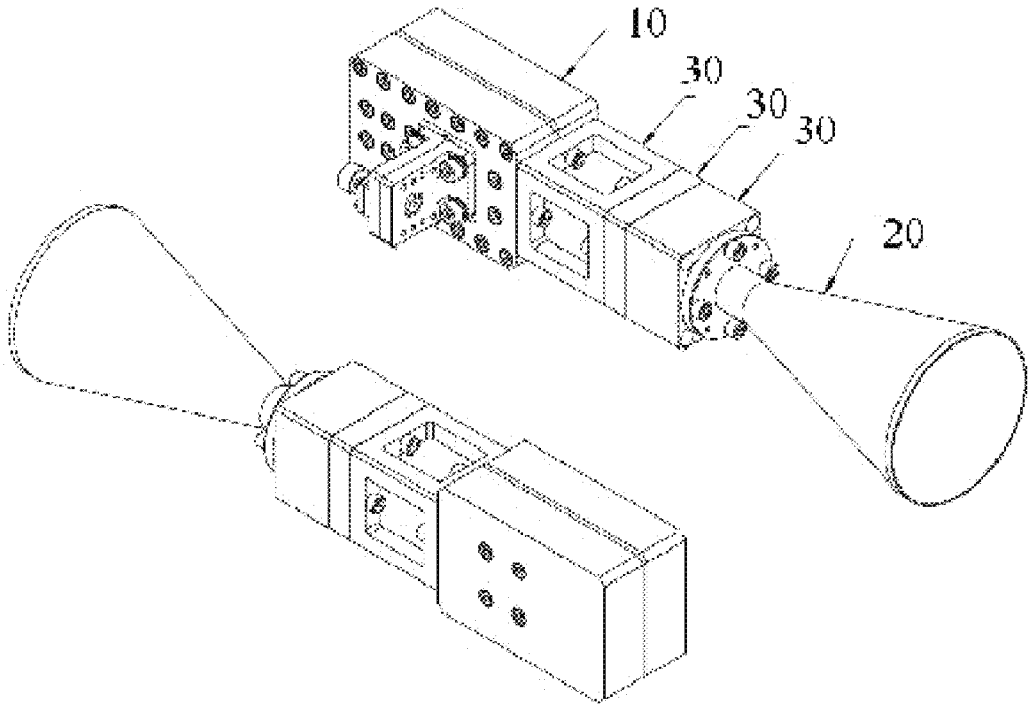
FIG. 34 is a schematic diagram 2 of an ultra-wideband Ortho-Mode Transducer according to this disclosure.
Figure 35:
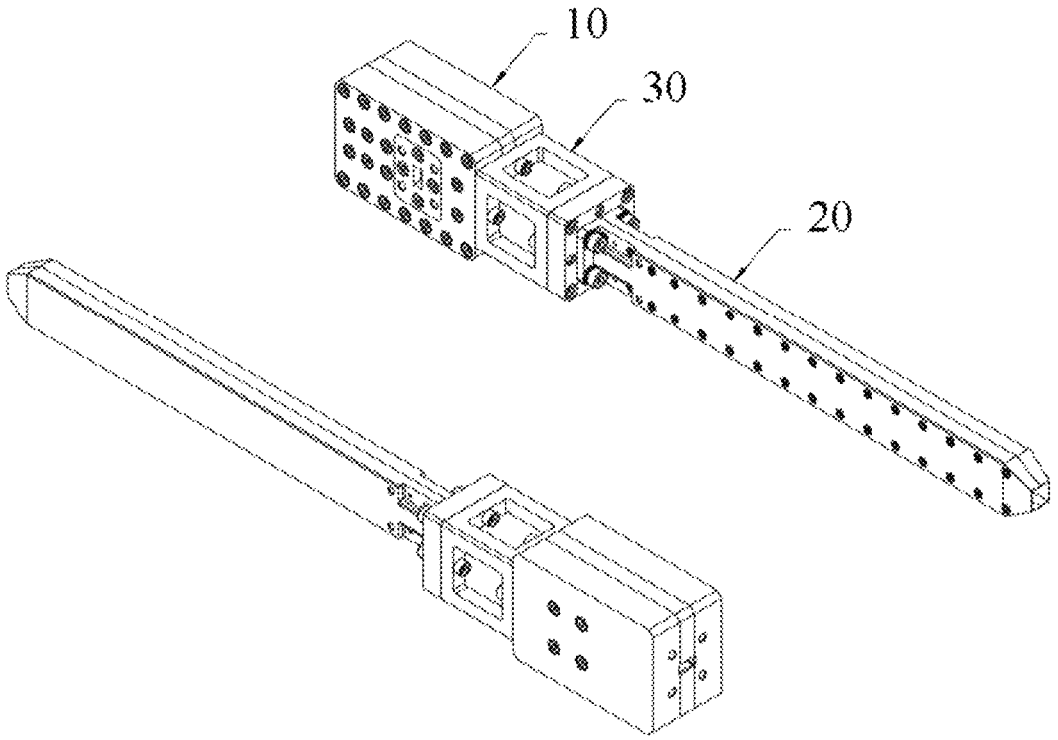
FIG. 35 is a schematic diagram 3 of an ultra-wideband Ortho-Mode Transducer according to this disclosure.
Figure 36:
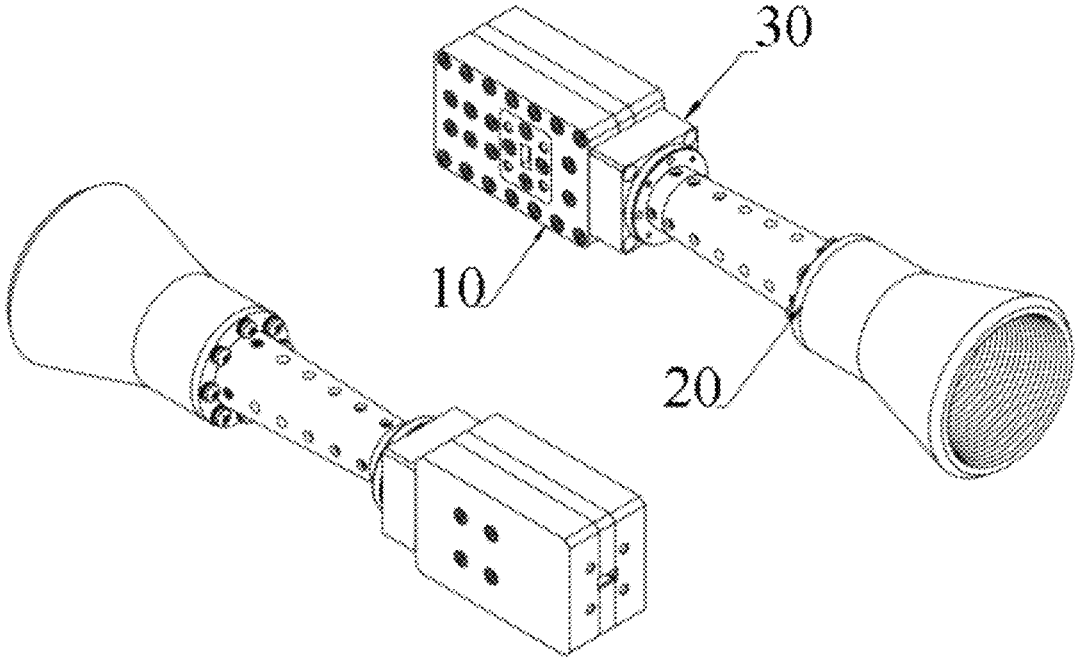
FIG. 36 is a schematic diagram 4 of an ultra-wideband Ortho-Mode Transducer according to this disclosure.
Figure 37:
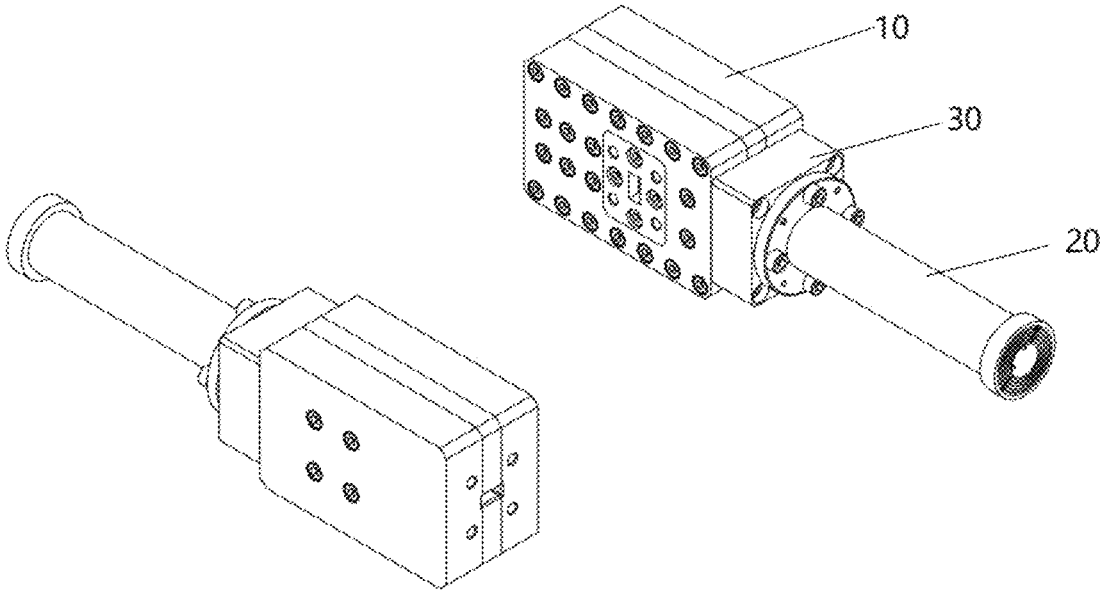
FIG. 37 is a schematic diagram 5 of an ultra-wideband Ortho-Mode Transducer according to this disclosure.

For many embodiments of an ultra-wideband Ortho-Mode Transducer provided in this disclosure, it is to be noted that the many embodiments may be combined with each other to obtain an ultra-wideband Ortho-Mode Transducer provided in this disclosure. For example, the ultra-wideband Ortho-Mode Transducer shown in FIG. 34 includes: a quad-ridge waveguide ultra-wideband Ortho-Mode Transducer, a dual polarization conical horn (radiation antenna), and a port transition device arranged in the ultra-wideband Ortho-Mode Transducer or the radiation antenna. For example, the ultra-wideband Ortho-Mode Transducer shown in FIG. 35 includes: a quad-ridge waveguide ultra-wideband Ortho-Mode Transducer, a dual polarization open ended waveguide probe antenna body (radiation antenna) and a port transition device arranged in the ultra-wideband Ortho-Mode Transducer or the radiation antenna. For example, the ultra-wideband Ortho-Mode Transducer shown in FIG. 36 includes: a quad-ridge waveguide ultra-wideband Ortho-Mode Transducer, a dual polarization quad-ridge corrugated horn (radiation antenna), and a port transition device arranged in the ultra-wideband Ortho-Mode Transducer or the radiation antenna. For example, the ultra-wideband Ortho-Mode Transducer shown in FIG. 37 includes: a quad-ridge waveguide ultra-wideband Ortho-Mode Transducer, a dual polarization quad-ridge feed (radiation antenna) and a port transition device arranged in the ultra-wideband Ortho-Mode Transducer or the radiation antenna.

The above is only the preferred embodiments of the present disclosure, not intended to limit the present disclosure. As wily occur to those skilled in the art, the present disclosure is susceptible to various modifications and changes. Any modifications, equivalent replacements, improvements and the like made within the spirit and principle of the present disclosure shall fall within the scope of protection of the present disclosure.

It is to be noted that terms used herein only aim to describe specific implementation manners, and are not intended to limit exemplar implementations of this disclosure. Unless otherwise directed by the context, singular forms of terms used herein are intended to include plural forms. Besides, it will be also appreciated that when terms "contain" and/or "include" are used in the description, it is indicated that features, steps, operations, devices, assemblies and/or a combination thereof exist.

Unless otherwise specified, relative arrangements of components and steps elaborated in these embodiments, numeric expressions and numeric values do not limit the scope of the present disclosure. Furthermore, it should be understood that for ease of descriptions, the size of each part shown in the drawings is not drawn in accordance with an actual proportional relation. Technologies, methods and devices known by those skilled in the related art may not be discussed in detail. However, where appropriate, the technologies, the methods and the devices shall be regarded as part of the authorized description. In all embodiments shown and discussed herein, any specific values shall be interpreted as only exemplar values instead of limited values. As a result, other embodiments of the exemplar embodiments may have different values. It is to be noted that similar marks and letters represent similar items in the following drawings. As a result, once a certain item is defined in one drawing, it is unnecessary to further discus the certain item in the subsequent drawings.

In the descriptions of the present disclosure, it will be appreciated that locative or positional relations indicated by "front, back, up, down, left, and right", "horizontal, vertical, perpendicular, and horizontal", "top and bottom" and other terms are locative or positional relations shown on the basis of the drawings, which are only intended to make it convenient to describe the present disclosure and to simplify the descriptions without indicating or impliedly indicating that the referring device or element must have a specific location and must be constructed and operated with the specific location, and accordingly it cannot be understood as limitations to the present disclosure. The nouns of locality "inner and outer" refer to the inner and outer contours of each component.

For ease of description, spatial relative terms such as "over", "above", "on an upper surface" and "upper" may be used herein for describing a spatial position relation between a device or feature and other devices or features shown in the drawings. It will be appreciated that the spatial relative terms aim to contain different orientations in usage or operation besides the orientations of the devices described in the drawings. For embodiment, if the devices in the drawings are inverted, devices described as "above other devices or structures" or "over other devices or structures" will be located as "below other devices or structures" or "under other devices or structures". Thus, an exemplar term "above" may include two orientations namely "above" and "below". The device may be located in other different modes (rotated by 90 degrees or located in other orientations), and spatial relative descriptions used herein are correspondingly explained.

In addition, it is to be noted that terms "first", "second" and the like are used to limit parts, and are only intended to distinguish corresponding parts. If there are no otherwise statements, the above terms do not have special meanings, such that they cannot be understood as limits to the scope of protection of the present disclosure.

What is claimed is:

1. A system including an antenna and an ultra-wideband Ortho-Mode Transducer (OMT) with ridges, comprising at least an ultra-wideband Ortho-Mode Transducer and a radiation antenna, wherein the ultra-wideband Ortho-Mode Transducer comprises a first channel inside, the radiation antenna comprises a second channel inside, a common port of the first channel is connected to a first antenna port of the second channel, a plurality of ridges with a square cross section are arranged in the first channel, and the plurality of ridges arranged in the first channel bulge into the first channel, wherein the common port of the first channel is a square port, and the number of the ridge is four, and one end of each ridge is arranged on a side wall of the square port, wherein the first channel is divided into a separation channel, a combining channel and a matching channel; one end of the separation channel is provided with the common port, and the other end is provided with two side ports and a through port; one end of the combining channel is connected to the two side ports of the separation channel, and the other end is a first rectangular port; one end of the matching channel is connected to the through port of the separation channel, and the other end is a second rectangular port;

the four ridges are divided into a first group of ridges and a second group of ridges; two ridges of the first group of ridges are located on a first side wall and a second side wall respectively and extends to the combining channel, the first side wall and the second side wall are opposite walls of the separation channel; two ridges of the second group of ridges are located on a third side wall and a fourth side wall respectively, the third side wall and the fourth side wall are opposite walls of the separation channel.

2. The system according to claim 1, wherein the combining channel comprises a combining sub-channel, a first conversion sub-channel and a second conversion sub-channel, a first end of the first conversion sub-channel and a first end of the second conversion sub-channel are connected to the two side ports of the separation channel respectively, and a second end of the first conversion sub-channel and a second end of the second conversion sub-channel are both connected to the combining sub-channel;

in a direction of close to the combining sub-channel, a height of each ridge of the first group of ridges gradually decreases in the first conversion channel and the second conversion channel, and is smoothly transited from a single-ridge waveguide to a rectangular waveguide, and the combining sub-channel is configured to combine two rectangular waveguides into one rectangular waveguide.

3. The system according to claim 2, wherein the two side ports are in an area of the separation channel, and the ridge pitch of the two ridges of the second group of ridges is the first threshold in the area of the separation channel.

4. The system according to claim 2, wherein in a direction from the first end to the second end of the first conversion channel, a ridged surface of the first conversion channel is widened from a first preset position; and in a direction from the first end to the second end of the second conversion channel, a ridged surface of the second conversion channel is widened from a second preset position.

5. The system according to claim 4, wherein after the ridge pitch of the two ridges of the second group of ridges becomes the first threshold, ridge side walls of each ridge of the second group of ridges are gradually separated at a preset angle until the distance between the ridge side walls of each ridge becomes a third threshold, and after the distance between the ridge side walls of each ridge becomes the third threshold, the ridge side walls are combined in pairs and transformed into side walls of the two side ports of the separation channel.

6. The system according to claim 4, wherein after the ridge pitch of the two ridges of the second group of ridges becomes the first threshold, a first side surface and a second side surface of the separation channel are turned at right angles to transform into the side walls of the two side ports of the separation channel, a longitudinal section of the first side surface and a longitudinal section the second side surface are L-shaped.

7. The system according to claim 5, wherein the matching channel is turned at a right angle at a first position, and a stepped structure is arranged on the outside of the first position.

8. The system according to claim 7, wherein the first transition port is a quad-ridge square port, a port shape of the quad-ridge square port matches the port shape of the common port, the second transition port is a quad-ridge circular port, and a port shape of the quad-ridge circular port matches the port shape of the first antenna port, the quad-ridge circular port is formed by uniformly arranging four ridges with a square cross-section on an inner wall of the circular port.

9. The system according to claim 7, wherein the first transition port is a quad-ridge square port, a port shape of the quad-ridge square port matches the port shape of the common port, the second transition port is a first circular port, and a port shape of the first circular port matches the port shape of the first antenna port the first circular port is a circular port without the ridge on an inner wall.

10. The system according to claim 7, wherein the first transition port is a quad-ridge square port, a port shape of the quad-ridge square port matches the port shape of the common port, the second transition port is a first square port, and a port shape of the first square port matches the port shape of the first antenna port, the first square port is a square port without the ridge on an inner wall.

11. The system according to claim 7, wherein the ultra-wideband Ortho-Mode Transducer satisfies at least one of following:

a first fixed portion is arranged on an outer periphery of the first transition port, the first fixed portion is configured to connect the port transition device and the ultra-wideband Ortho-Mode Transducer;

a second fixed portion is arranged on an outer periphery of the second transition port, the second fixed portion is configured to connect the port transition device and the radiation antenna.

12. The system according to claim 10, wherein in a case that the plurality of grooves are the plurality of concentric circular grooves, the plurality of concentric circular grooves are arranged at equal intervals on the outer periphery of the second antenna port; and in a case that the plurality of grooves are the plurality of annular grooves, the plurality of annular grooves are arranged side by side on the inner wall of the second channel along the electromagnetic wave transmission direction, the first antenna port is a port, away from the horn caliber surface portion, of the second channel, and the second antenna port is a port, near the horn caliber surface portion, of the second channel.

13. The system according to claim 10, wherein the second channel located in the transition portion is a first antenna channel and the second channel located in the horn caliber surface portion is a second antenna channel, in a direction from the first antenna port to the second antenna port, the radiation antenna satisfies at least one of following:

a channel diameter of the first antenna channel remains unchanged or increases gradually;

a channel diameter of the second antenna channel remains unchanged or increases gradually.

14. The system according to claim 10, wherein the second channel located in the transition portion is a first antenna channel and the second channel located in the horn caliber surface portion is a second antenna channel, wherein the first antenna channel is provided with a plurality of ridges of antenna with a square cross-section side by side at equal intervals, and the ridges of antenna on an inner wall of the first antenna channel bulge into the first antenna channel, wherein in a direction from the first antenna port to the second antenna port, a height of the antenna ridge arranged on the inner wall of the first antenna channel gradually decreases, wherein the antenna ridge arranged on the inner wall of the first antenna channel is divided into a first part, a second part and a third part, a height of the first part is constant, a height of the second part decreases linearly, and a height of the third part decreases curvedly, wherein in a case that N ridges of antenna are arranged on the inner wall of the first antenna channel, the transition portion of the radiation antenna is provided with N groups of first connecting members, and second connecting members are arranged on bottom surfaces of the N ridges of antenna, the first connecting members and the second connecting members are cooperatively configured to fix the ridges of antenna on the inner wall of the first antenna channel, wherein in a case that N ridges of antenna are arranged on the inner wall of the first antenna channel, N positioning grooves are provided on the inner wall of the first antenna channel of the radiation antenna, the positioning grooves and the ridges of antenna are arranged in a one-to-one correspondence to fix the ridges of antenna into the positioning grooves, wherein the radiation antenna further comprises a third fixed portion, the third fixed portion is arranged on an outer periphery of the first antenna port, and the third fixed portion is provided with at least one third connecting member for fixed the radiation antenna.

15. The system according to claim 1, wherein the second group of ridges satisfies at least one of following:

in a direction extending from the common port to the inside of the first channel, a height of each ridge of the second group of ridges gradually increases from a third preset position until a ridge pitch between the two ridges of the second group of ridges becomes a first threshold, the first threshold is a cross-sectional width of the through port of the separation channel;

in a direction extending from the common port to the inside of the first channel, a width of each ridge of the second group of ridges gradually decreases from a fourth preset position until the width of each ridge of the second group of ridges becomes a second threshold.

16. The system according to claim 1, wherein the matching channel smoothly transits the through port of the separation channel to a standard rectangular port based on a staircase structure, and a broadside size of each step in the staircase structure meets the Chebyshev impedance transformation.

17. The system according to claim 1, wherein the ultra-wideband Ortho-Mode Transducer is composed of a plurality of components, the plurality of components are connected to form the first channel, each ridge is arranged on any one of the components.

18. The system according to claim 1, wherein in a case that a port shape of the common port does not match a port shape of the first antenna port, the ultra-wideband Ortho-Mode Transducer further comprises a port transition device, the port transition device comprises a third channel inside, a first transition port of the third channel is connected to the common port and a port shape of the first transition port matches the port shape of the common port, a second transition port of the third channel is connected to the first antenna port and a port shape of the second transition port matches the port shape of the first antenna port, and the third channel is configured to smoothly transit the first transition port into the second transition port.

19. The system according to claim 1, wherein in a case that a port shape of the common port does not match a port shape of the first antenna port, the radiation antenna further comprises a port transition device, the port transition device comprises a third channel inside, a first transition port of the third channel is connected to the common port and a port shape of the first transition port matches the port shape of the common port, a second transition port of the third channel is connected to the first antenna port and a port shape of the second transition port matches the port shape of the first antenna port, and the third channel is configured to smoothly transit the first transition port into the second transition port.

20. The system according to claim 1, wherein the radiation antenna is divided into a transition portion and a horn caliber surface portion along an electromagnetic wave transmission direction, and the horn caliber surface portion is provided with a plurality of grooves, the plurality of grooves is a plurality of concentric circular grooves or a plurality of annular grooves, the plurality of concentric circular grooves are provided on a top surface of the horn caliber surface portion, and the plurality of annular grooves are provided along an inner wall of the second channel of the horn caliber surface portion.

* * * * *